US011812824B2

(12) United States Patent
Ringholz et al.

(10) Patent No.: US 11,812,824 B2
(45) Date of Patent: Nov. 14, 2023

(54) FOOTWEAR CLOSURE SYSTEM

(71) Applicant: Finiks, Inc., Mill Valley, CA (US)

(72) Inventors: Ryan Ringholz, Mill Valley, CA (US); Hung-Chia Lin, Tainan (TW)

(73) Assignee: Plae Co., Honolulu, HI (US)

( * ) Notice: Subject to any disclaimer, the term of this patent is extended or adjusted under 35 U.S.C. 154(b) by 690 days.

(21) Appl. No.: 15/336,094

(22) Filed: Oct. 27, 2016

(65) Prior Publication Data

US 2017/0112237 A1 Apr. 27, 2017

Related U.S. Application Data

(60) Provisional application No. 62/298,712, filed on Feb. 23, 2016, provisional application No. 62/246,742, filed on Oct. 27, 2015.

(51) Int. Cl.
*A43C 1/06* (2006.01)
*A43C 1/00* (2006.01)
(Continued)

(52) U.S. Cl.
CPC ..... *A43C 1/06* (2013.01); *A43C 1/006* (2013.01); *A43C 1/02* (2013.01); *A43C 5/00* (2013.01);
(Continued)

(58) Field of Classification Search
CPC ..... A43C 15/00; A43C 15/02; A43C 15/061; A43C 15/06; A43C 15/04; A43C 11/165;
(Continued)

(56) References Cited

U.S. PATENT DOCUMENTS 440,806 A * 11/1890 Griffen ..... A43C 7/00 24/712.4
1,385,362 A 7/1921 Coombs
(Continued)

FOREIGN PATENT DOCUMENTS

DE 20102157 U1 6/2001
FR 2891602 A1 4/2007
WO WO-2010030066 A1 * 3/2010 ..... A43C 11/16

OTHER PUBLICATIONS

Justin, "Sensori Venture Xero Shoes (P)review!", http://birthdayshoes.com/sensori-venture-xero-shoes-p-review, accessed Dec. 20, 2016, pp. 1-11.
(Continued)

*Primary Examiner* — Aiying Zhao
(74) *Attorney, Agent, or Firm* — Hansen IP Law PLLC

(57) ABSTRACT

A closure system for a shoe includes a single shoelace which can be secured and tightened through the use of one hand. The shoe includes a button around which the shoelace is wrapped to facilitate easy removal of the shoe. In one embodiment one end of the shoelace is secured under the upper of the shoe near the toe and a second end of the shoelace is secured in a slider that is slidably mounted on the rear of the shoe to provide micro-adjustments of the tightness of the shoe. Alternatively, the shoe includes a strip of piping around the rear of the shoe and a slider in which the second end of the shoelace is secured slides along the piping when the user wants to make micro-adjustments.

11 Claims, 26 Drawing Sheets

(51) Int. Cl.
*A43C 9/02* (2006.01)
*A43C 11/00* (2006.01)
*A43C 1/02* (2006.01)
*A43C 5/00* (2006.01)
*A43C 7/00* (2006.01)

(52) U.S. Cl.
CPC ..... *A43C 7/00* (2013.01); *A43C 9/02* (2013.01); *A43C 11/008* (2013.01)

(58) Field of Classification Search
CPC ..... A43C 11/008; A43C 11/12; A43C 11/00; A43C 1/006; A43C 1/06; A43C 1/02; A43C 9/02; A43C 7/00; A43C 1/04; A43C 11/16; A43C 1/003; A43B 3/16; A43B 3/18; A43B 7/14; Y10T 24/3703
USPC ..... 36/50.1, 62, 105
See application file for complete search history.

(56) References Cited

U.S. PATENT DOCUMENTS 1,715,247 A * 5/1929 Reeves ..... A43C 9/02 24/713.1
2,901,796 A * 9/1959 Hope ..... A44B 1/34 24/108
2,961,727 A * 11/1960 Coffey ..... A43C 9/02 24/715.6
3,701,572 A * 10/1972 Velasquez ..... A43C 1/02 24/712.4
5,016,327 A * 5/1991 Klausner ..... A43C 1/00 24/442
5,463,822 A * 11/1995 Miller ..... A43C 11/00 36/50.1
5,471,769 A * 12/1995 Sink ..... A43B 11/00 24/712.1
5,537,763 A * 7/1996 Donnadieu ..... A43C 1/00 36/50.1
5,873,183 A * 2/1999 Posner ..... A43C 7/00 24/712
6,032,387 A * 3/2000 Johnson ..... A43C 1/06 36/118.1
7,168,190 B1 * 1/2007 Gillespie ..... A43B 3/24 36/102
7,721,468 B1 * 5/2010 Johnson ..... A43C 11/008 36/50.1
8,201,346 B2 * 6/2012 Darby, II ..... A43B 7/00 36/100
2001/0025434 A1 * 10/2001 Fellouhe ..... A43B 3/0031 36/50.1
2005/0060912 A1 * 3/2005 Holzer ..... A43C 1/00 36/50.1
2005/0126043 A1 * 6/2005 Reagan ..... A43B 3/0031 36/50.5
2006/0156517 A1 * 7/2006 Hammerslag ..... A43B 5/16 24/68 SK
2006/0254089 A1 * 11/2006 Frydlewski ..... A43C 11/00 36/50.1
2007/0011910 A1 * 1/2007 Keen ..... A43B 3/22 36/50.1
2007/0068040 A1 * 3/2007 Farys ..... A43C 1/04 36/50.1
2007/0169378 A1 * 7/2007 Sodeberg ..... A43C 1/00 36/50.5
2008/0060167 A1 * 3/2008 Hammerslag ..... A43B 5/16 24/68 SK
2008/0066346 A1 * 3/2008 Hammerslag ..... A43B 5/16 36/50.1
2008/0172848 A1 * 7/2008 Chen ..... A43C 1/00 24/68 SK
2009/0100717 A1 * 4/2009 Cabanis ..... A43B 5/0411 36/116
2010/0101061 A1 * 4/2010 Ha ..... A43B 3/0042 24/712.5
2010/0101114 A1 * 4/2010 Reagan ..... A43B 3/0031 36/117.1
2010/0139057 A1 * 6/2010 Soderberg ..... A43C 11/16 24/68 R
2010/0175278 A1 * 7/2010 Seliger ..... A43B 5/0401 36/117.1
2010/0319216 A1 * 12/2010 Grenzke ..... A43B 11/00 36/54
2011/0099843 A1 * 5/2011 Jung ..... A43C 1/06 36/50.1
2011/0225843 A1 * 9/2011 Kerns ..... A43B 3/0052 36/50.1
2012/0017469 A1 * 1/2012 Kishino ..... A43C 7/00 36/50.1
2012/0144700 A1 * 6/2012 Zhao ..... A43B 5/0401 36/99
2012/0240428 A1 * 9/2012 Knoll ..... A43B 5/0427 36/50.1
2013/0091731 A1 * 4/2013 Wang ..... A43B 13/14 36/99
2013/0092780 A1 * 4/2013 Soderberg ..... A43C 11/165 242/396.4
2013/0269219 A1 * 10/2013 Burns ..... A43C 11/165 36/136
2014/0007391 A1 * 1/2014 Siegfreid ..... A43C 7/00 24/713
2014/0123449 A1 * 5/2014 Soderberg ..... A43C 1/003 24/712.1
2014/0157627 A1 * 6/2014 Smaldone ..... A43B 5/0401 36/83
2014/0196312 A1 * 7/2014 Sakaue ..... A43C 1/06 36/50.1
2014/0208550 A1 * 7/2014 Neiley ..... A43C 7/00 24/712.1
2014/0290016 A1 * 10/2014 Lovett ..... A43C 11/20 24/713.5
2014/0366340 A1 * 12/2014 Park ..... A43C 3/00 24/712.2
2015/0007422 A1 * 1/2015 Cavanagh ..... A43C 11/165 24/68 SK
2015/0059206 A1 * 3/2015 Lovett ..... A43C 11/165 36/50.1
2015/0076272 A1 * 3/2015 Trudel ..... A43C 7/00 242/381.4
2015/0257489 A1 * 9/2015 Trudel ..... A43C 11/20 24/68 SK
2015/0289595 A1 * 10/2015 Rushbrook ..... A43C 11/22 36/50.1
2015/0289609 A1 * 10/2015 Gittens ..... A44C 5/22 24/714.6

OTHER PUBLICATIONS

International Search Report and Written Opinion issued by the U.S. Patent and Trademark Office as International Search Report, issued in PCT/US16/59136, dated Mar. 23, 2017 (13 pages).
European Extended Search Report issued in EP16860794.3, dated Aug. 1, 2019 (13 pages).

* cited by examiner

FOOTWEAR CLOSURE SYSTEM

CROSS-REFERENCE TO RELATED APPLICATIONS

This application relates to and claims priority under 35 U.S.C. §119(e) to U.S. Provisional Patent Application No. 62/298712, titled "FOOTWEAR CLOSURE SYSTEM," which was filed on Feb. 23, 2016 and U.S. Provisional Patent Application No. 62/246742, titled "SHOE CLOSURE SYSTEM," which was filed on Oct. 27, 2015 and are hereby incorporated by reference in their entirety.

BACKGROUND OF THE INVENTION

This invention relates to shoes and a shoelace system for tightening a shoe on a user's foot.

Many shoes currently sold on the market include shoelaces. Shoelaces must be generally tied with two hands and the person tying the shoes must have some dexterity and coordination to be able to tie a bow in the shoe. For this reason, it is not only very difficult for children to tie shoelaces but it is also difficult for certain physically disabled people, especially individuals who only have the use of one hand. Often such individuals are forced to wear loafers or other shoes that are more easily closed than shoes with shoelaces.

Shoes often become untied because of the pressure placed on the bow by the constant movement of the tongue caused by the instep. Such movement often causes a loosening of the bow, thereby causing shoes to become untied, which then requires retying of the shoelaces. Wearers of such shoes are routinely concerned about their shoes becoming untied.

Often when a person is wearing a shoe, the initial adjustment changes as feet tend to swell, thereby making the shoe tighter. Users also often like to change the tension on the closure system of a shoe depending upon the activity in which they are engaging. For these reasons, it is desirable to provide the ability for a wearer to make micro adjustments in a shoe that would allow for small amounts of loosening or tightening of the shoe closure system.

It is, therefore, a principal object of the present invention to provide a shoe with an improved shoelace closure system.

Another object of the present invention is to provide a shoelace closure system that can easily be tightened with one hand and that enables the user to make micro adjustments.

Still another object of the present invention is to provide a shoelace closure system that resists becoming unintentionally untied.

SUMMARY OF INVENTION

The closure system for a shoe of the present invention includes a single shoelace which can be secured and tightened through the use of one hand. The shoe includes a button around which the shoelace is wrapped to facilitate easy removal of the shoe. In one embodiment one end of the shoelace is secured under the upper of the shoe near the toe and a second end of the shoelace is secured in a slider that is slidably mounted on the rear of the shoe to provide micro-adjustments of the tightness of the shoe. In another embodiment, the shoe includes a strip of piping around the rear of the shoe and a slider in which the second end of the shoelace is secured slides along the piping when the user wants to make micro-adjustments. In still another embodiment, the adjustment of the tightness of the shoe is made by sliding a barrel that is located over the top of the tongue of the shoe near location where the user's foot is inserted into the shoe. The button around which the shoelace is fastened is removable to change the look of the shoe.

These are the features and objects of the present invention will be more fully understood from the following detailed description which should be read in light of the accompanying drawings, in which corresponding reference numerals refer to corresponding parts throughout the several views.

DETAILED DESCRIPTION

Figure 1:
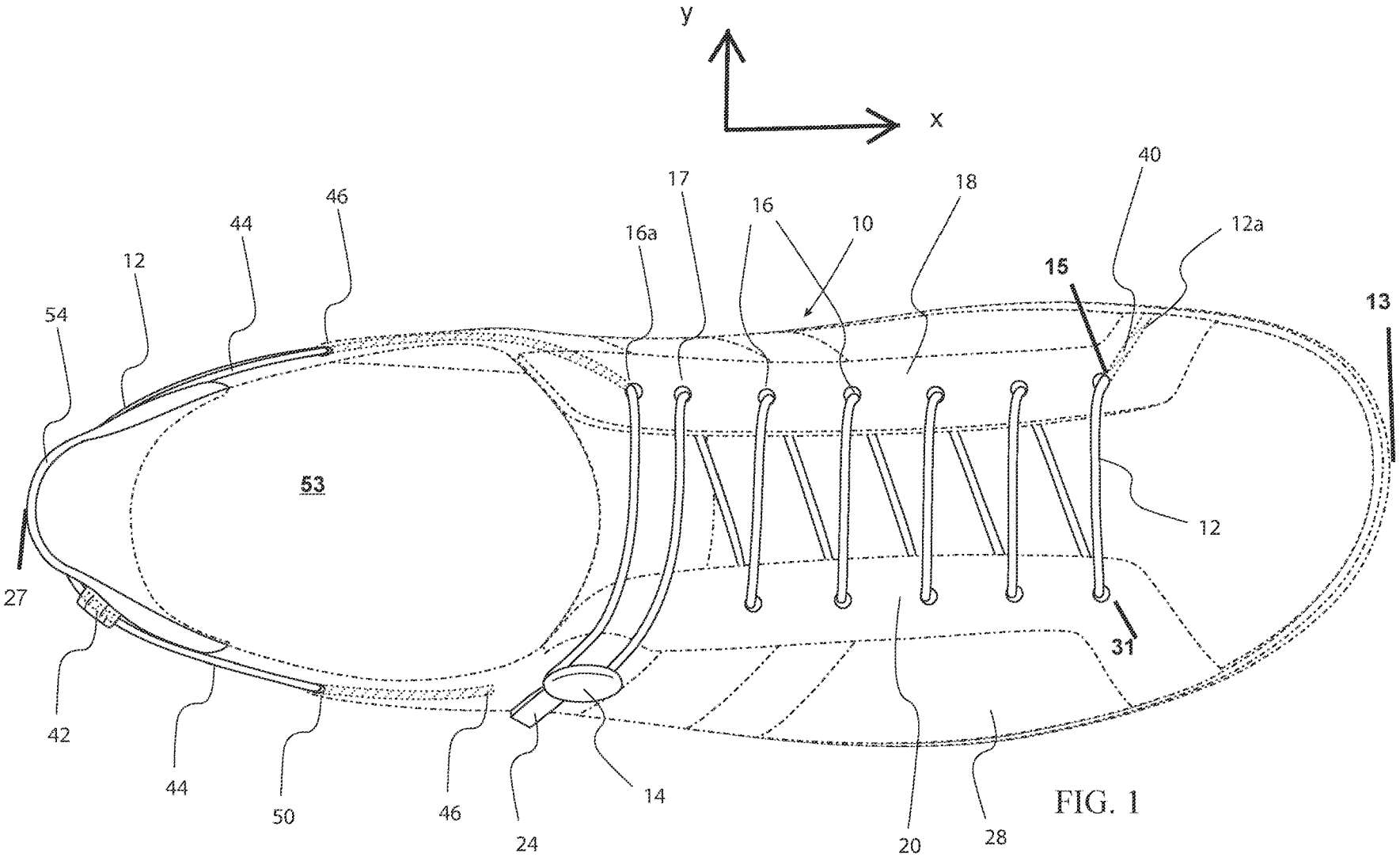
FIG. 1 is a top view of a shoe utilizing an embodiment of the closure system of the present invention.

Referring to FIGS. 1-8 one embodiment of the closure system of the present invention for a shoe 10 is shown in which the closure system includes single shoelace 12. The shoelace 12 is a single strand. Shoe 10 includes a rearmost (or heel) portion 27 and a foremost (or toe) portion 13 which define a shoe length axis x between the rearmost portion. 27 and the foremost portion 13. Eyelets 15 and 31 are located opposite one another and spaced apart from one another along by a distance that defines a lateral-medial y axis and are closest to foremost (toe) portion 13 of shoe 10 in a direction along shoe length axis x. One end 12*a* of shoelace 12 is secured to a shoe under flap 18 on the medial side of the shoe 10 and defines a second position 40 along the shoe length axis x. Eyelet 15 defines a first position along shoe length axis x. The second position is spaced apart from the first position in a direction along the shoe length axis x from the first position to a third position on the shoe length axis defined by the foremost (toe) portion 13. Flap 18 is located on a medial side 43 of shoe 10. and flap 20 is located on a lateral side 41 of shoe 10. The flaps 18 and 20 are spaced apart by a distance along lateral-medial axisy. The shoelace 12 can be either stitched to upper 18 or glued to the upper at location 40. Shoe 10 includes a sole 29 and an opening 53 into which a wearer of shoe 10 inserts his or her foot. As best seeen in FIGS. 7-8, sole 29 and opening 53 are spaced apart along a shoe height axis z.

Figure 1A:
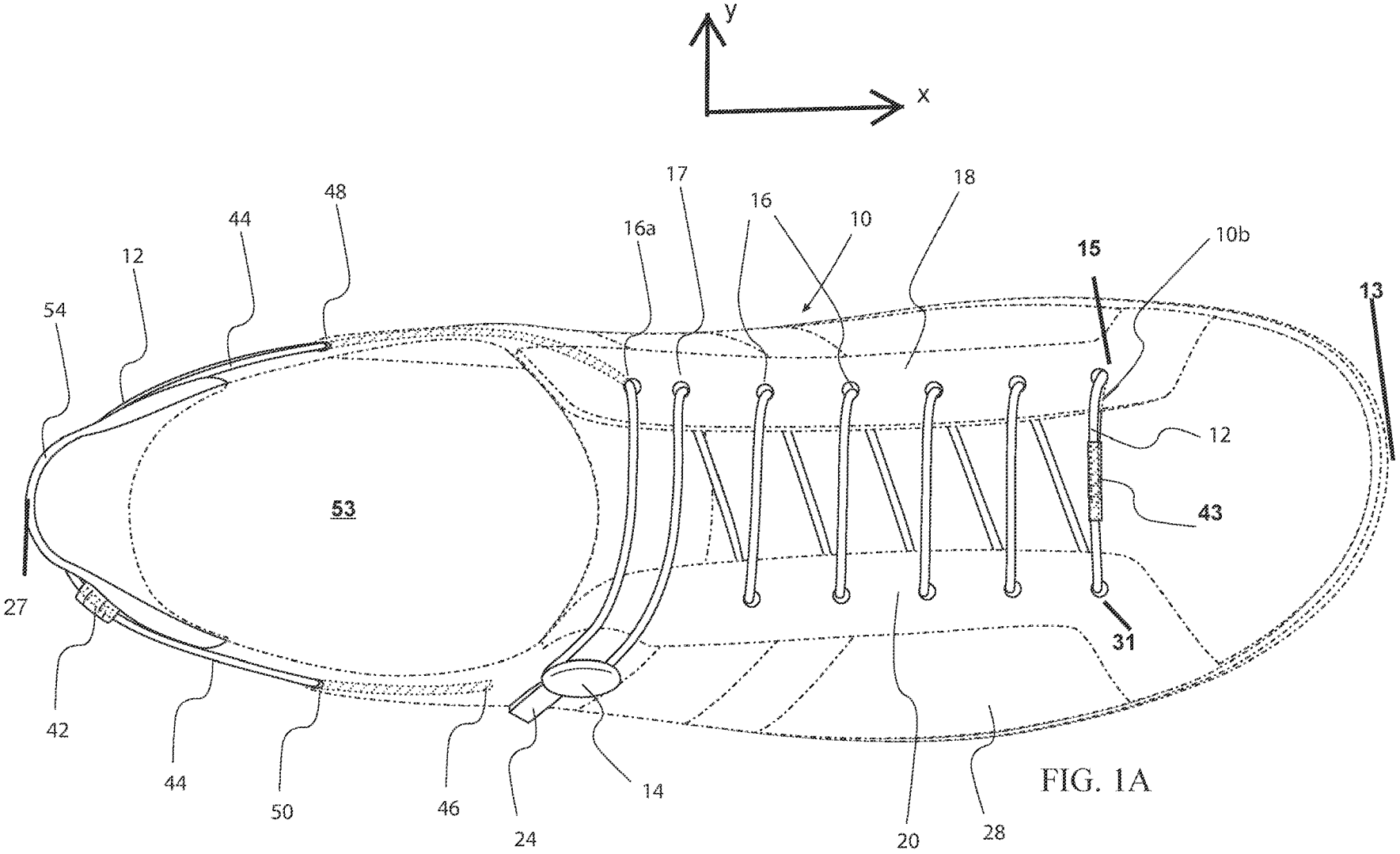
FIG. 1A is a top view of a shoe utilizing another alternative of embodiment of the closure system shown in FIG. 1.
Figure 2:
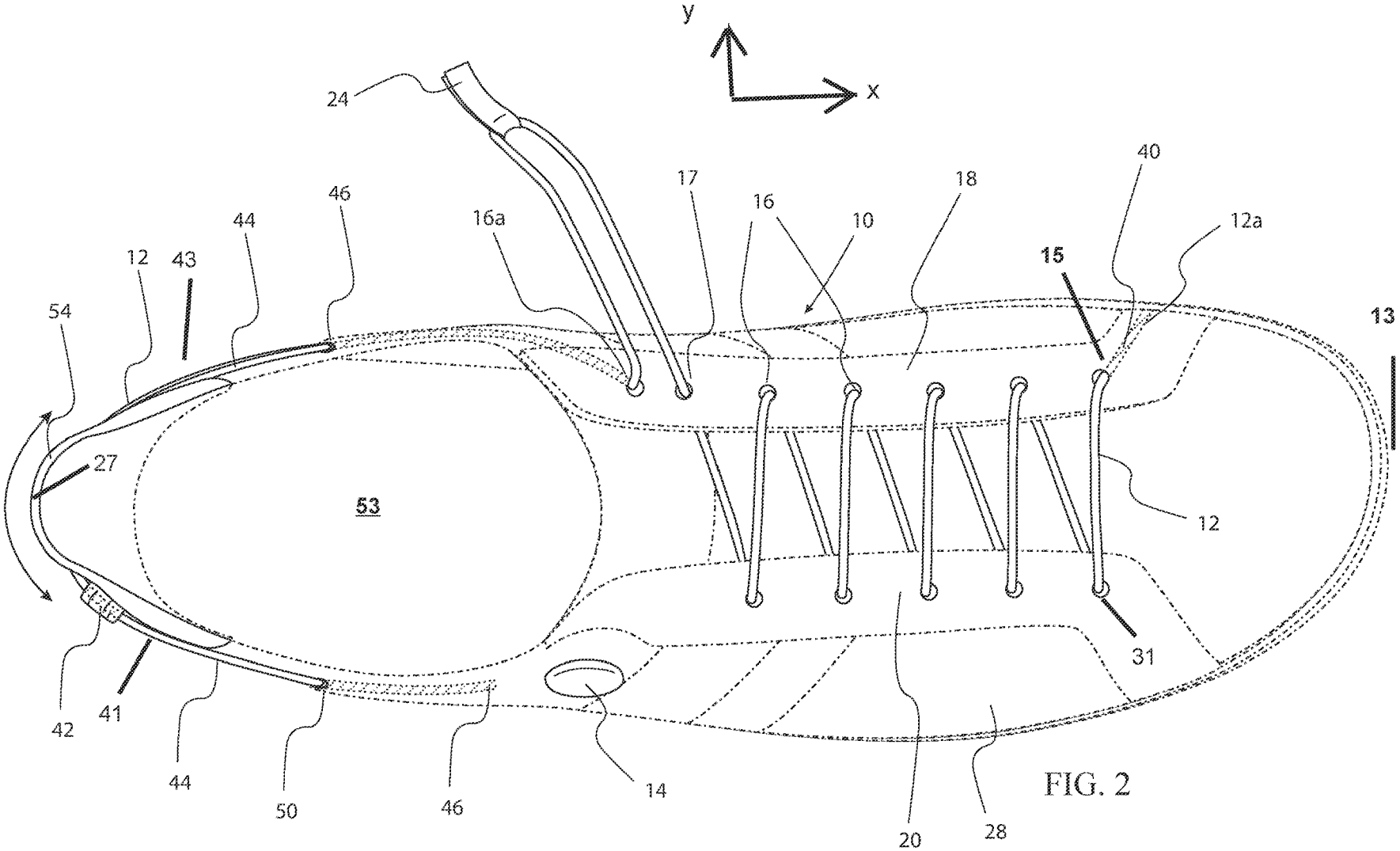
FIG. 2 is a top view of a shoe utilizing an alternative closure system shown in FIG. 1 in which shoelace is untied.
Figure 3:
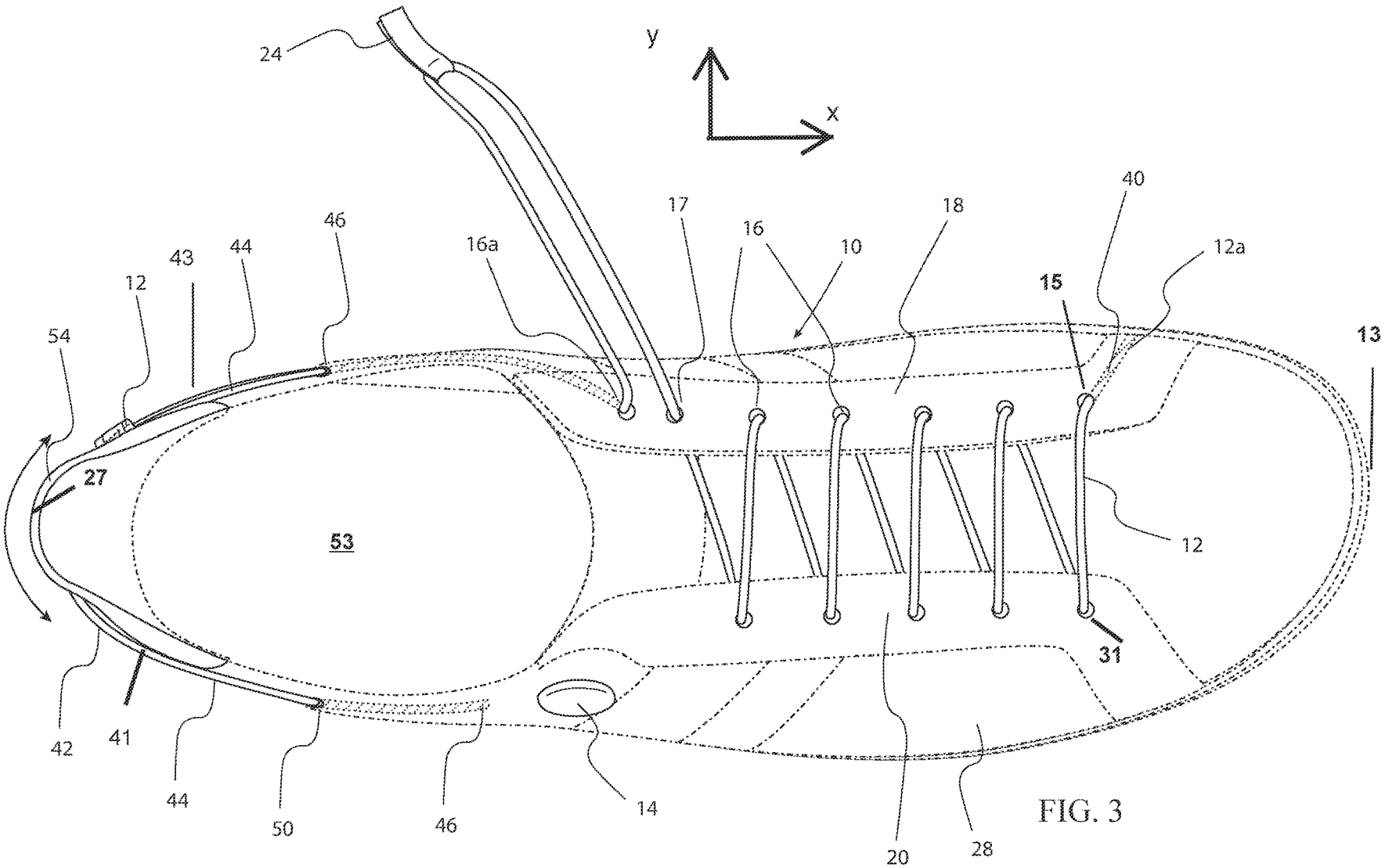
FIG. 3 is a top view of the shoe shown in FIG. 1 with the slider adjusted from the location in FIG. 2.
Figure 4:
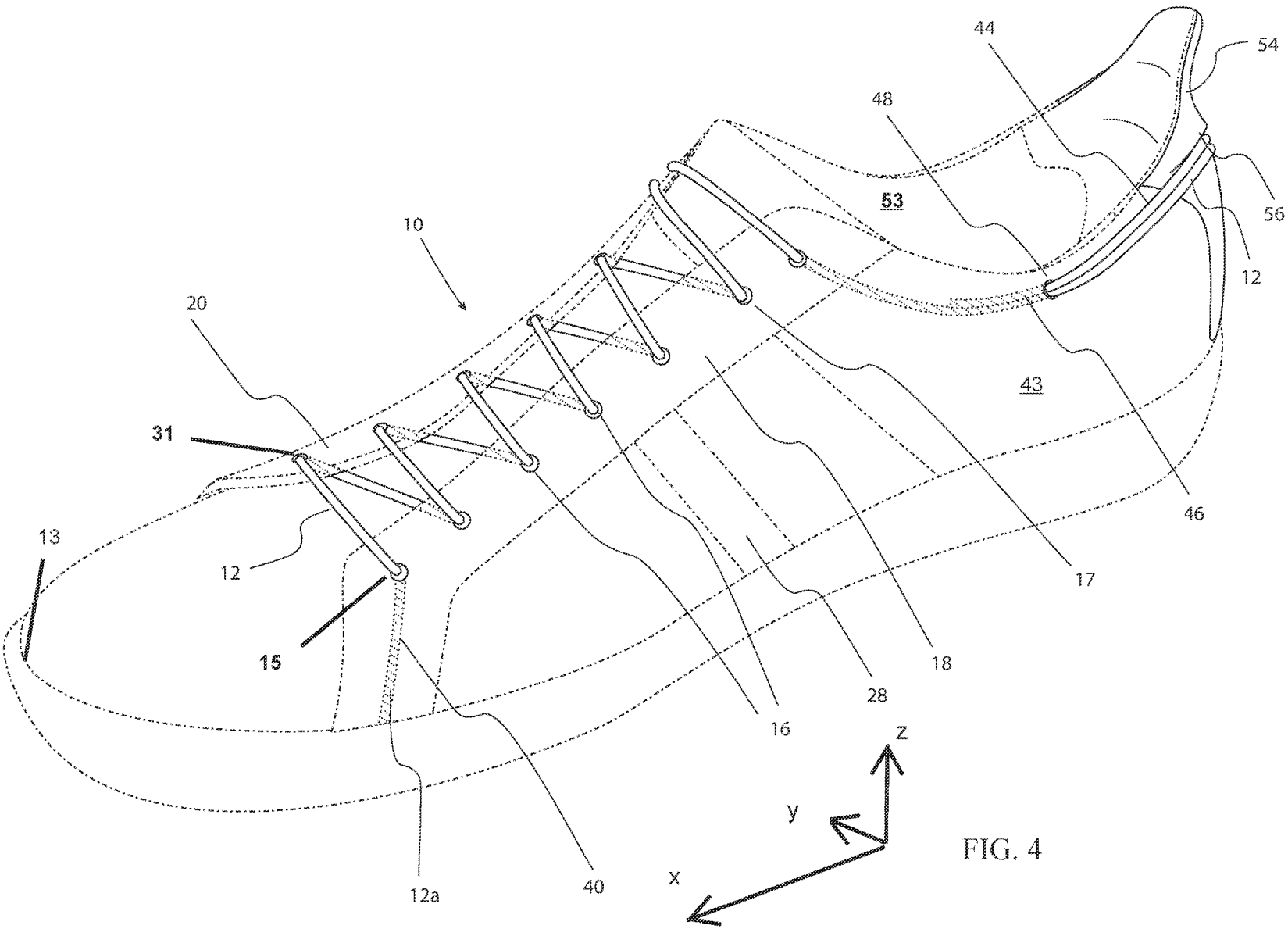
FIG. 4 is a medial side perspective view of the shoe shown in FIG. 2.
Figure 5:
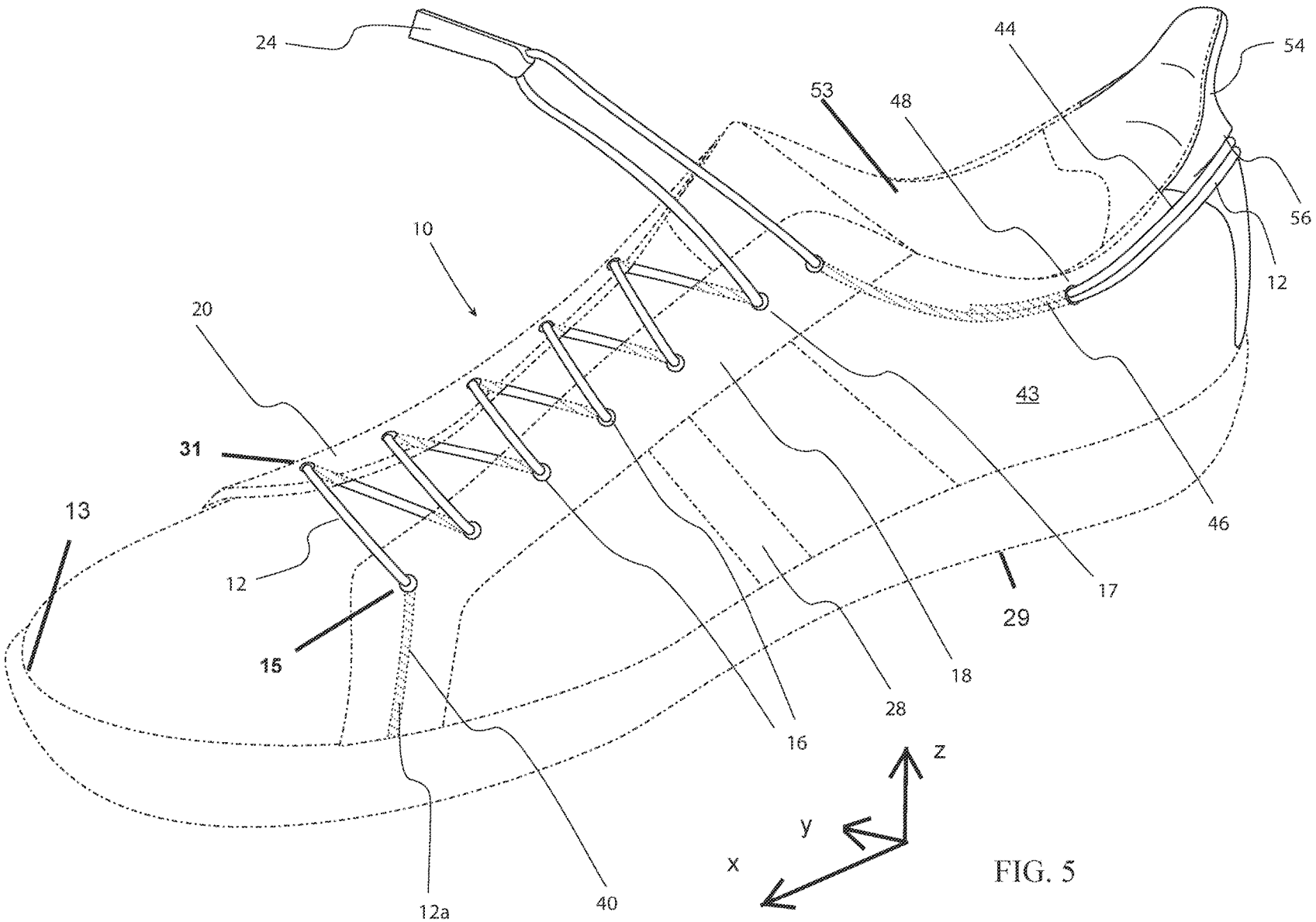
FIG. 5 is a medial side perspective view of the shoe shown in FIG. 1 with the shoelace in an unsecured position.
Figure 6:
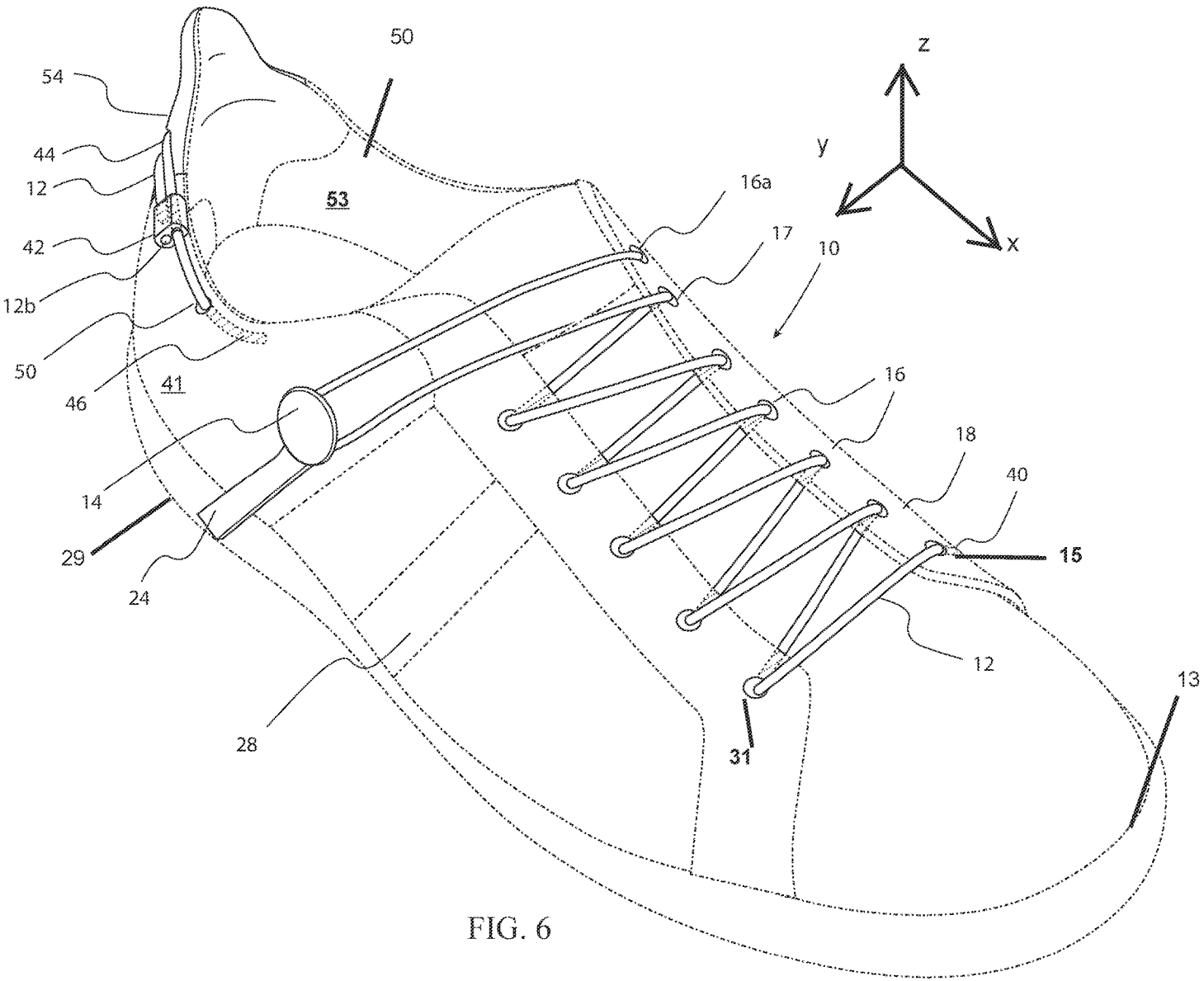
FIG. 6 is a lateral side perspective view of the shoe shown in FIG. 1 with a lace in a secured position.

In the alternate embodiment shown in FIG. 1A, the shoelace 12 is secured to the shoe 10 by being crimped to itself at crimped portion 43. A first end 12*a* (not visible in FIG. 1A) of shoelace 12 is located in crimped portion 43 and defines a second position along the lateral-medial axis y. Eyelet 15 is an eyelet located closest to the toe portion of the shoe 10 and defines a first position along the lateral-medial axis y. A third eyelet 31 which is opposite the first eyelet 15 alone the lateral-medial axis defines a third position along, the lateral-medial axis. The second position is spaced apart from the first position in a direction from the first position to the third position along the lateral-medial axisy. In addition, first end 12*a* is located between eyelet 15 and opposing eyelet 31 along the lateral-medial axis y. Folded over portion 10*b* includes the first end 12*a* of shoelace 12.

The shoelace 12 is threaded alternately through eyelets 16 from location 40 back towards the opening 53 in the shoe where the user's foot inserted. A shoelace pull 24 is secured to the shoelace 12 that is in a position on the shoelace 12 after the shoelace passes through the second to last eyelet 17. The shoelace pull 24 is secured to the shoelace 12 to facilitate the pulling of the shoelace 12 over button 14.

Figure 12B:
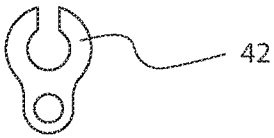
FIG. 12B is an elevational view of a slider utilized in the closure system of FIG. 13.
Figure 12A:
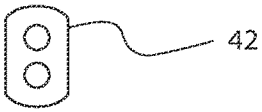
FIG. 12A is an elevational view of a slider utilized in the closure system of FIG. 1.

A second end 12*b* (best shown in FIGS. 6-8) of shoelace 12 is secured to a slider 42 but any known securing means such as stitching or glue. A cross section of the slider utilized in this embodiment is shown in FIG. 12A. A cord 44 extends from the media side 43 to the lateral side 41 of the shoe and is secured along each side of the opening 53 of the shoe where the user inserts his or her foot and around the rear of the shoe. Cord 44 and slider 42 define a second position along the shoe vertical axis z. Sole 29 defines a first position along the shoe vertical z axis. The opening 53 where the user inserts his or her foot defines a third posiition along the vetica axis. The second position is spaced apart from the first position in a direction along the shoe vertical z axis from the first position to the third position. This cord 44 can be either stitched or glued to the interior of the shoe at locations 46 on each side of the shoe 10. The slider 42 is mounted on cord 44 and will slide around the rear of the shoe on cord 44 from the medial side 43 to the lateral side 41 of the shoe 10 and from a first position on the lateral-medial axis y to a second position on the lateral-medial axis y. Both the shoelace 12 and the cord 44 will pass from under the upper 28 on the medial side 43 of the shoe 10 through opening 48 along the medial side 43 of the shoe 10. Both the shoelace 12 and the cord 44 extend out of opening 48 around the rear of the shoe. The cord 44 is then inserted through opening 50 on the lateral side 41 of the shoe where the cord 44 is secured inside the shoe 10 under the upper 28 either by glue, stitching or other appropriate securing method.

Figure 7:
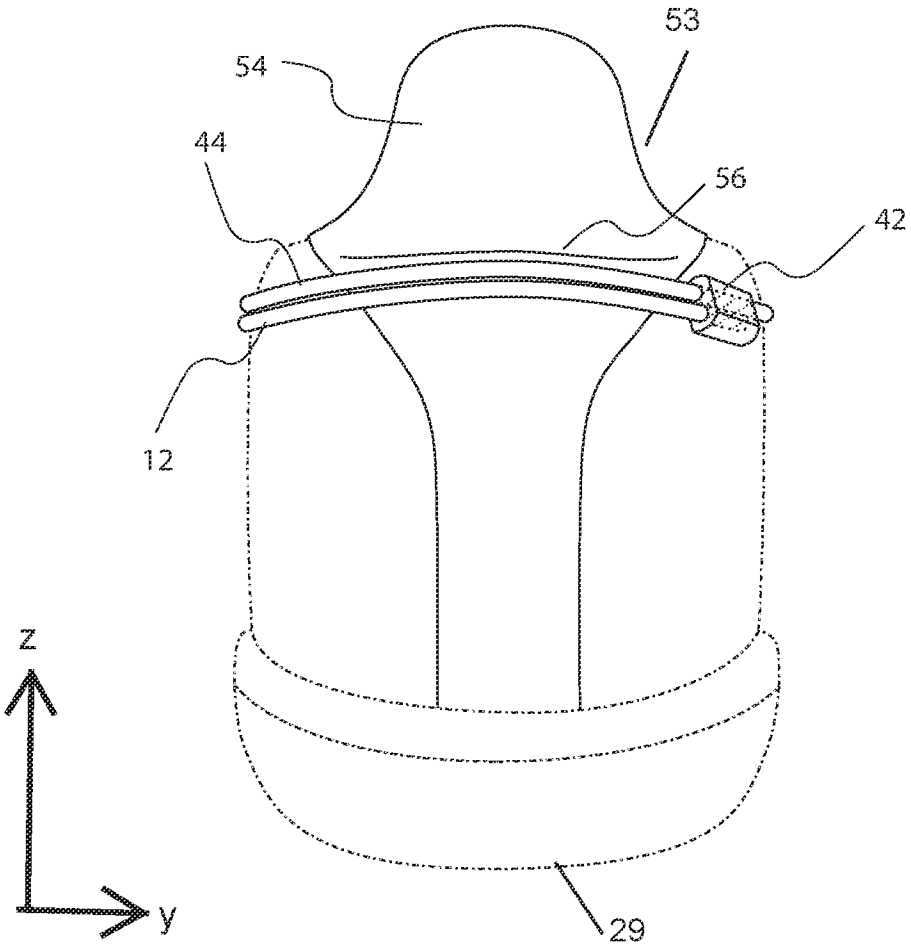
FIG. 7 is a rear elevational view of the shoe shown in FIG. 1.

To adjust the tightening of the shoelace 12 on the shoe 10, the slider 42 is slid along cord 44 thereby pulling the shoelace 12 with it. As the slider 42 is pulled around the shoe from the medial to the lateral side the shoelace 12 is tightened when the slider 42 is moved from the lateral side to the medial side of the shoe as shown in FIG. 7 (compared to FIG. 8), the shoelace 12 is loosened as more slack in the shoelace 12 is provided. The slider 42 is pressure fit on cord 44 so that the slider 42 remains in place after the slider 42 is moved around the shoelace 12. The direction of the movement of the slider 42 is indicated by arrow 52 in FIG. 8.

Figure 8:
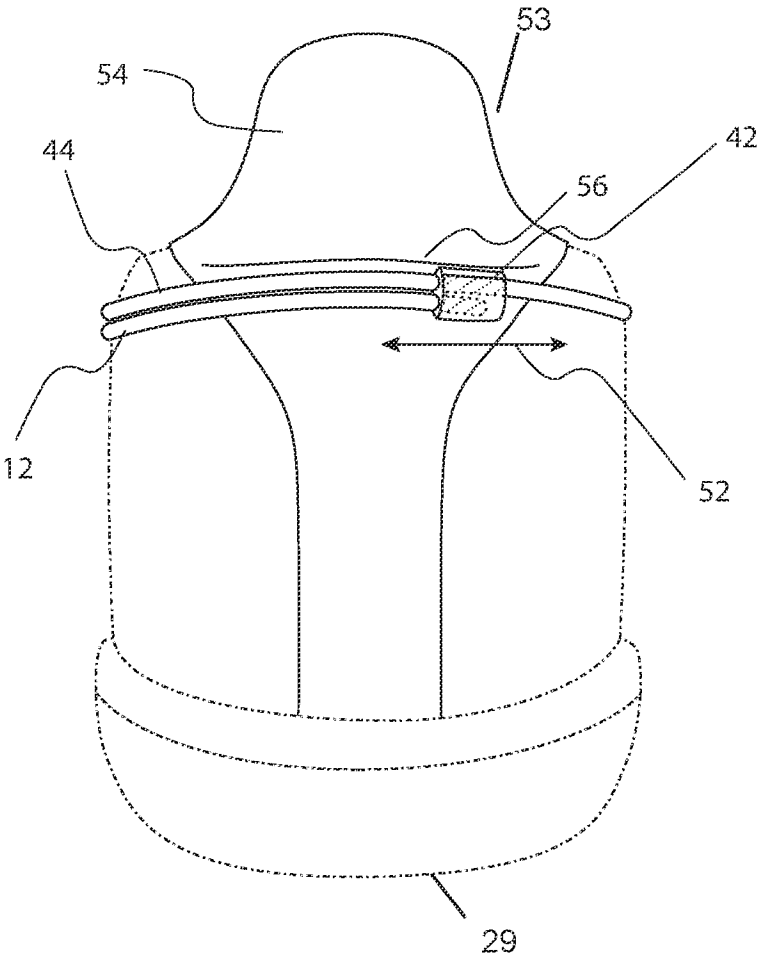
FIG. 8 is a rear elevational view of the shoe shown in FIG. 1 showing a slider adjustment.

As shown most clearly in FIGS. 7 and 8, a heel tab 54 includes a molded ridge 56 which provides a track for shoelace 12 and cord 44 to prevent the shoelace 12 and cord 44 from sliding up the heel tab 54 and causing irritation on the wear's ankle/Achilles.

Figure 9:
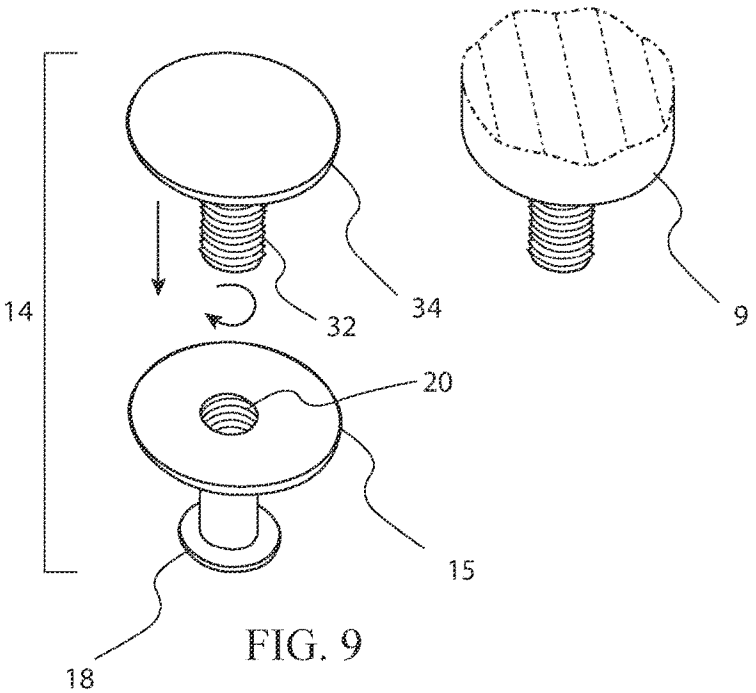
FIG. 9 is an exploded perspective view of the button used in the closure system of FIG. 1.
Figure 10:
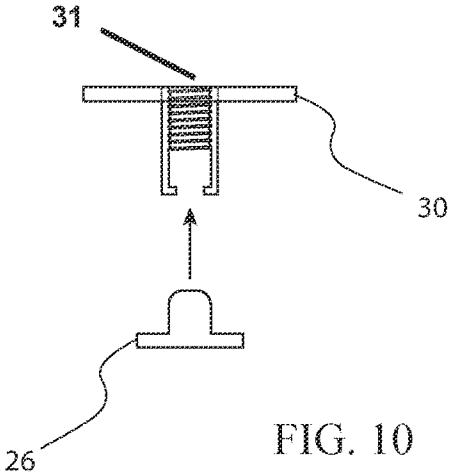
FIG. 10 is a side view of the button used in the closure system of FIG. 1 prior to assembly.
Figure 11:
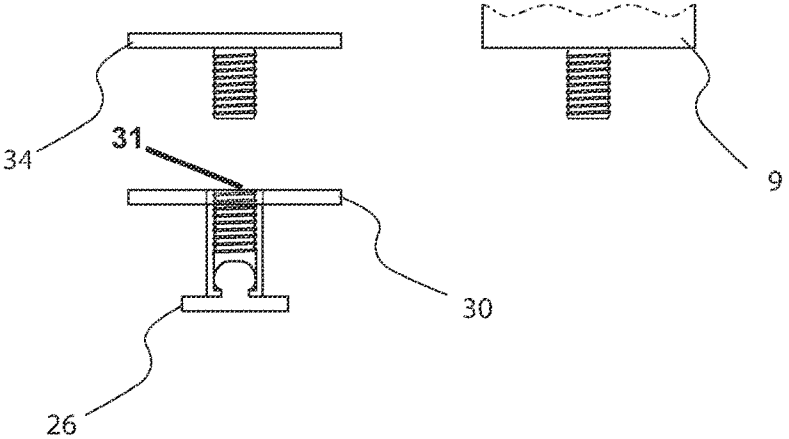
FIG. 11 is a side view of the button used in the closure system of FIG. 1 after the button is assembled.

The button 14 is designed to be removable to change the aesthetic look of the shoe 10. Referring to FIGS. 9-11, a rivet 26 is inserted through the upper 28 on the lateral side of the shoe 10 so that the base of the rivet 26 lies under the upper 28. A base button 30 is fitted to the rivet 26 so that the top surface of the base button 30 is above the exterior surface of the upper 28 and the barrel of the base button 30 passes through the upper 28. Base button 30 includes a hollow threaded post (female) 31 that will receive the solid (male) threaded post 32 of the top button 34 of the button 14. It is anticipated that top button 34 will have alternate designs to change the aesthetic appearance of the shoe 10. For example, the top button 34 could be provided in different colors, shapes, topography, graphics or materials, which would be changed in a manner similar to cufflinks but instead used on shoes. The interchangeability of top button 34 would certainly provide a unique option for identification, self-expression, or complementing ones wardrobe. Button 9 in FIGS. 9 and 11 is another example of button 14 with a different topography. The button could also include a wearable device or other electronic device that provides functions such as motion/step tracking, GPS, Bluetooth, etc.

Turning to the alternative embodiment shown in FIGS. 13-20, the construction of the shoe 10 is nearly identical to the shoe shown in FIGS. 1-8 except that instead of including the cord 44 in the embodiment of FIGS. 1-8, piping 58 is positioned around the rear of the shoe 10 and extends from medial side 43 to lateral side 41. In the embodiment of FIGS. 13-20, the slider 44 will slide along the piping 58 from medial side 43 to lateral side instead of riding along cord 44 as shown in the embodiment of FIGS. 1-8.

Figure 13:
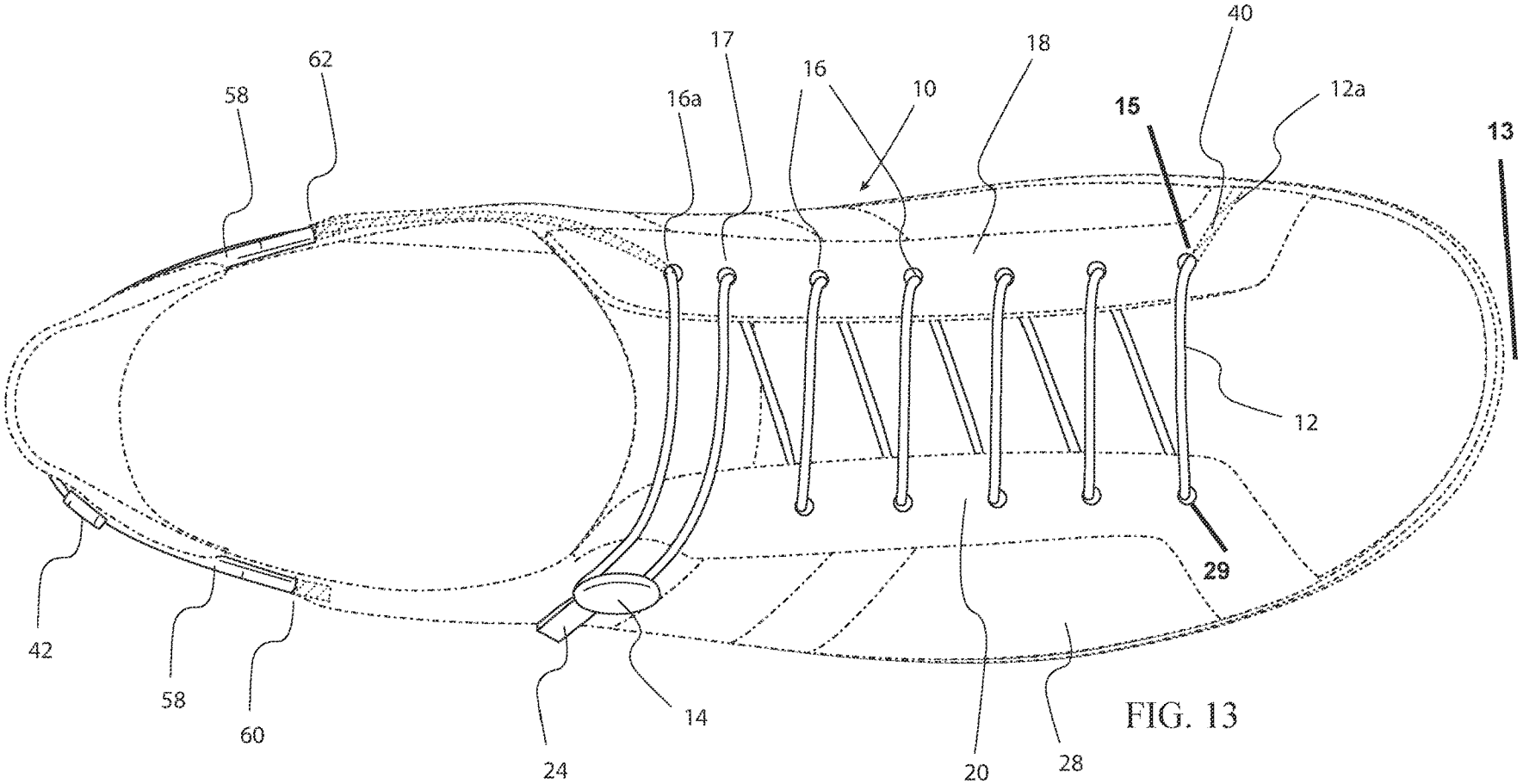
FIG. 13 is a top view of a shoe utilizing an alternate embodiment of the closure system of the present invention with the shoelace in a secured position.
Figure 13A:
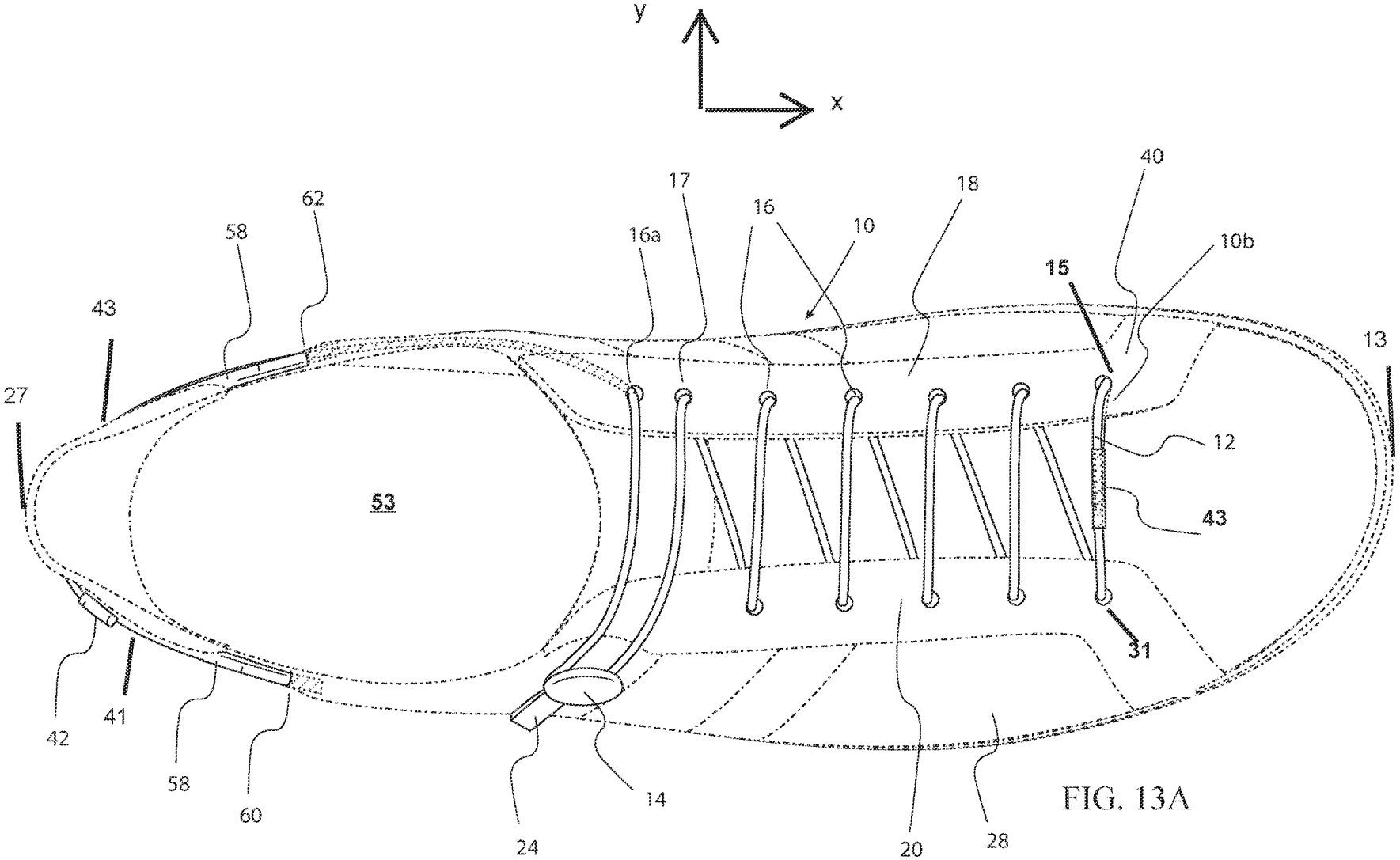
FIG. 13A is a top view of a shoe utilizing another alternative embodiment of the closure system shown in FIG. 13.
Figure 14:
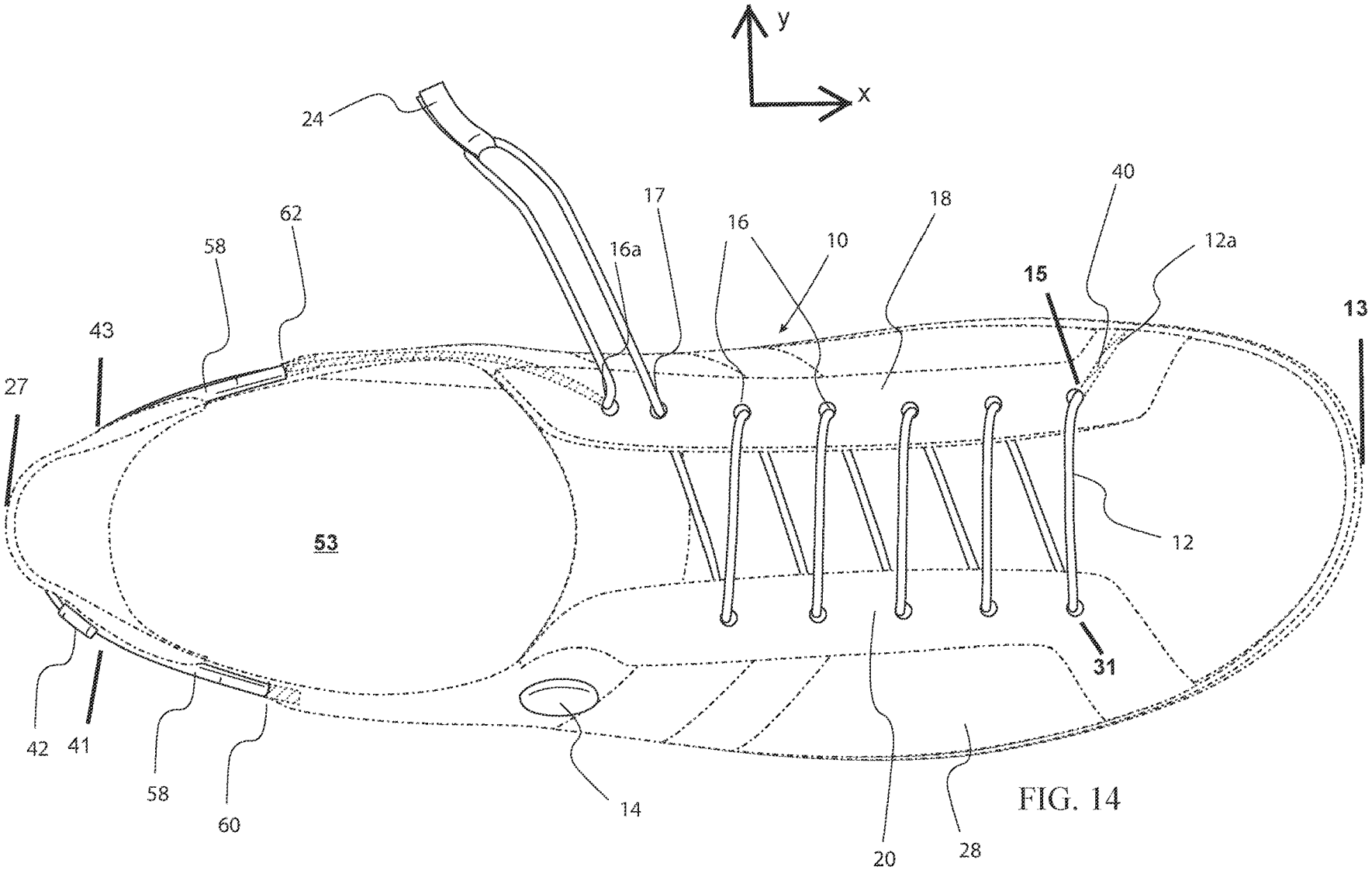
FIG. 14 is a top view of the shoe utilizing the closure system shown in FIG. 13 in which the shoelace is utilized.
Figure 15:
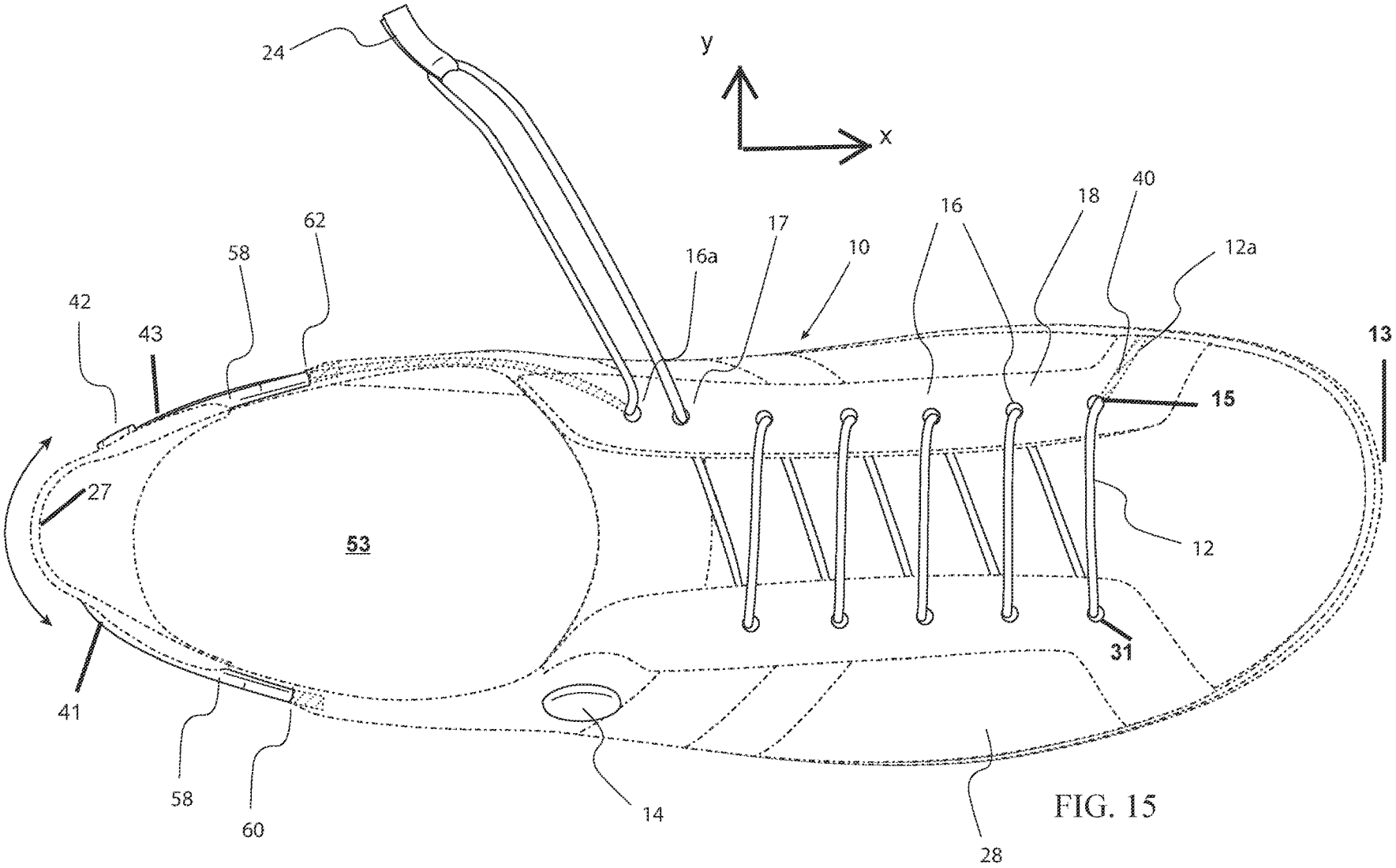
FIG. 15 is a top view of the shoe utilizing the closure system shown in FIG. 13 with the slider adjusted from the location of FIG. 14.
Figure 16:
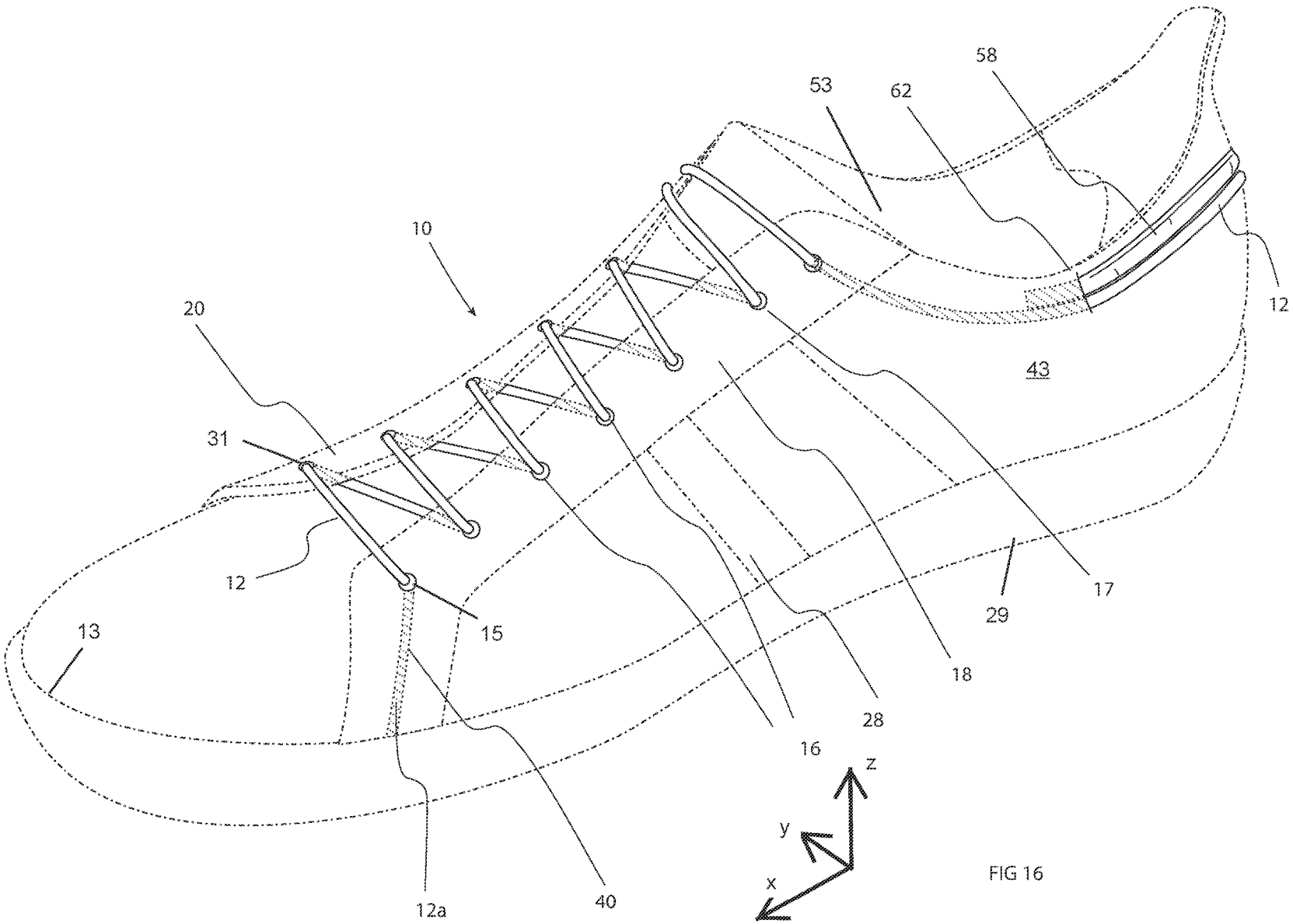
FIG. 16 is a medial side perspective view of the shoe utilizing the closure system shown in FIG. 23.
Figure 17:
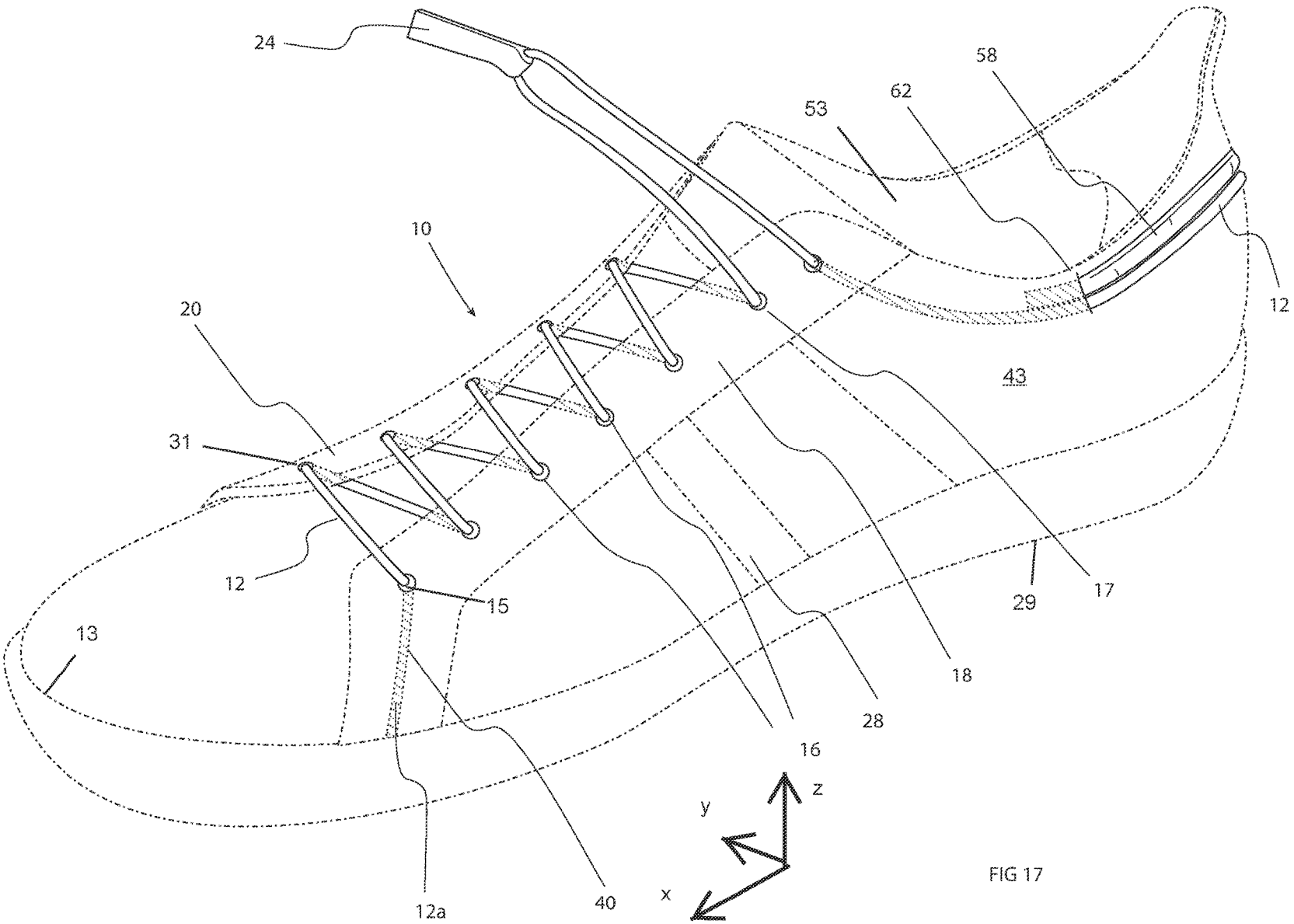
FIG. 17 is a medial side perspective view of the shoe utilizing the closure system shown in FIG. 23 with the shoelace in an unsecured position.
Figure 18:
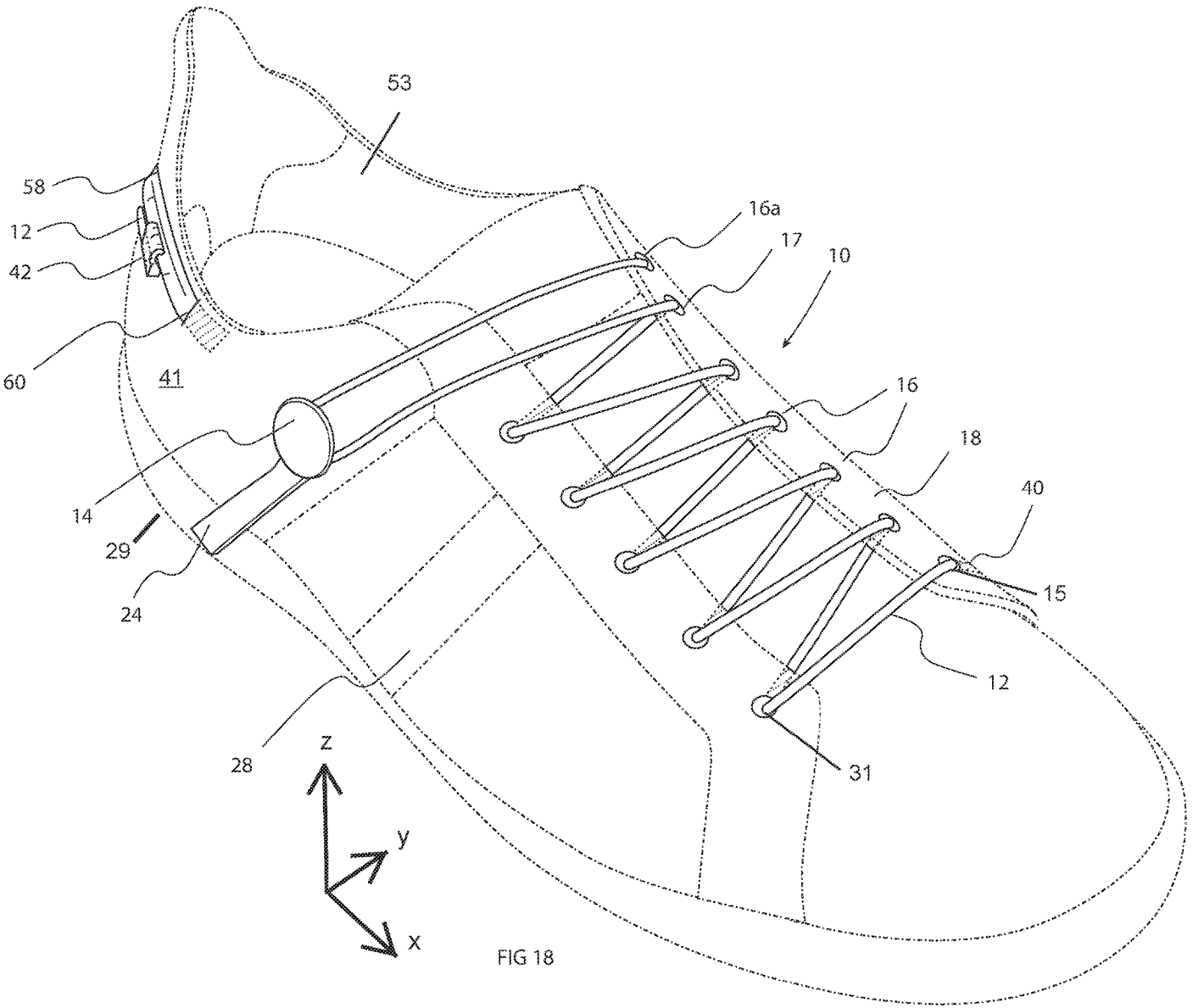
FIG. 18 is a lateral side view as the shoe shown in FIG. 23.
Figure 20:
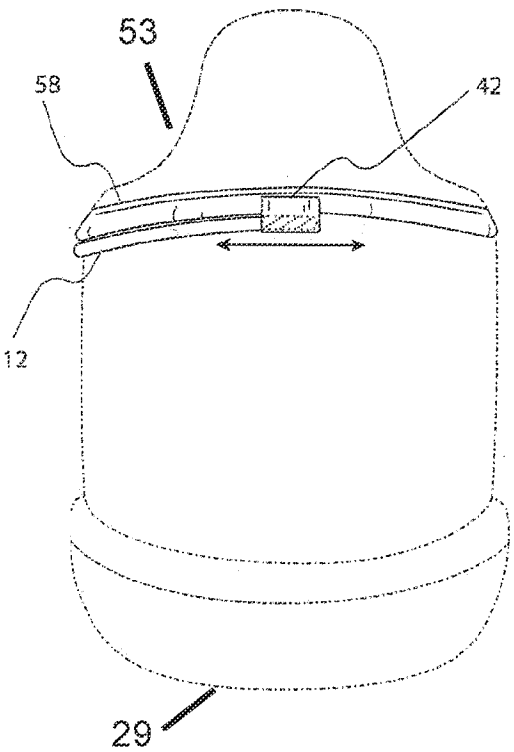
FIG. 20 is a rear elevational view of a shoe utilizing the closure system shown in FIG. 23.
Figure 19:
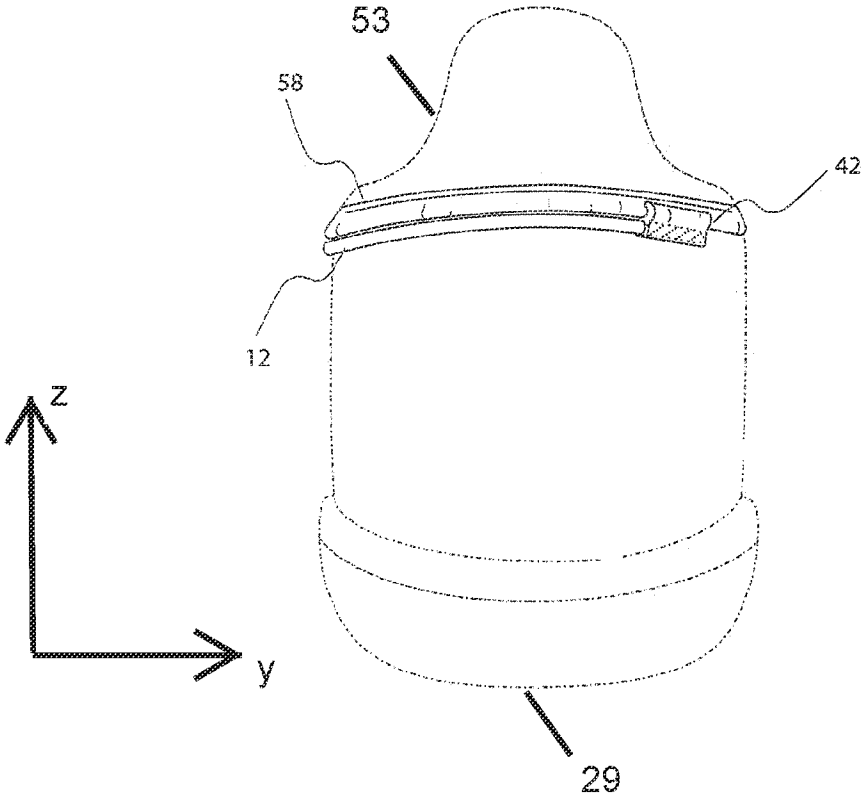
FIG. 19 is a rear elevational perspective view of a shoe utilizing the closure system shown in FIG. 23.
Figure 21:
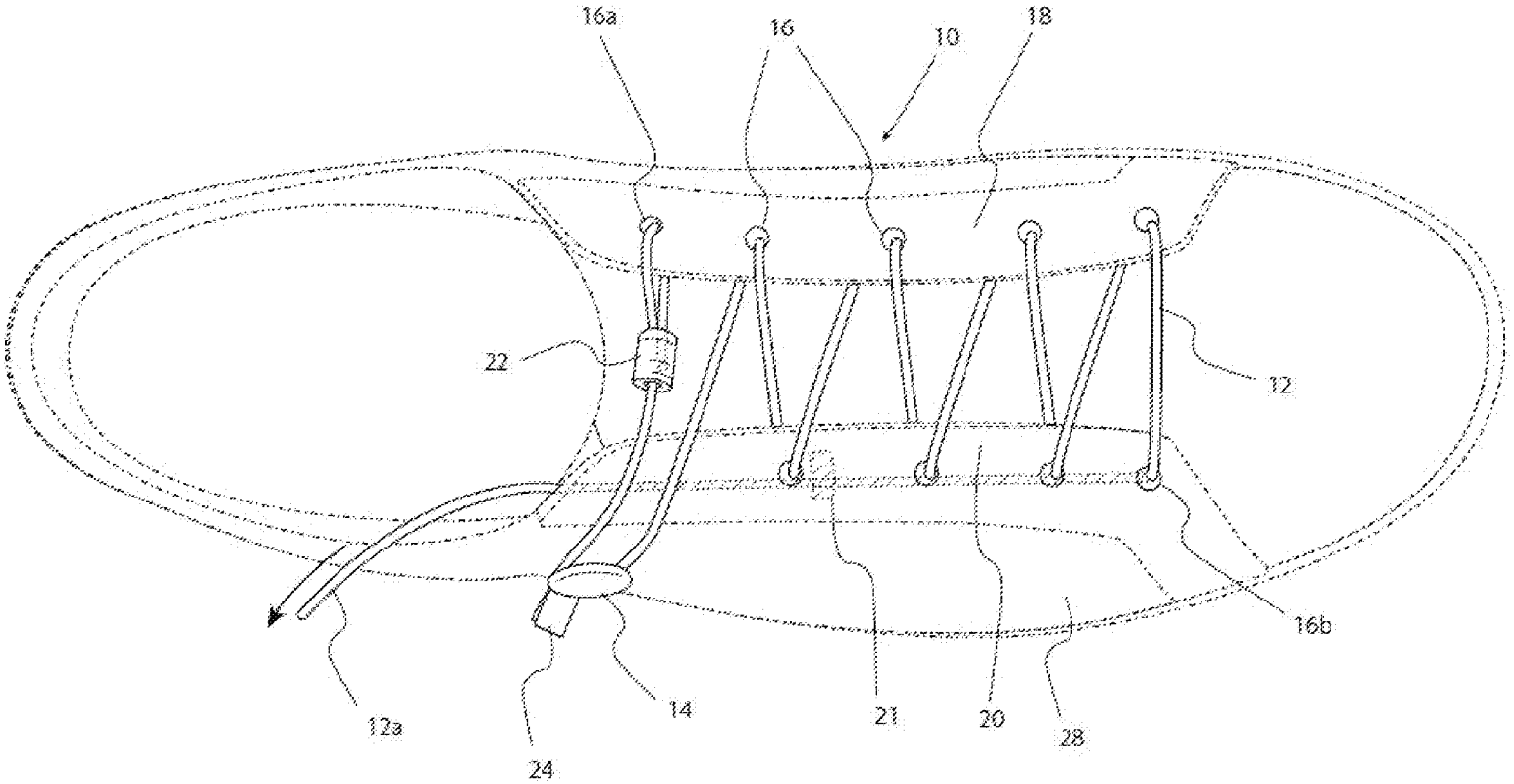
FIG. 21 is a top view of a shoe utilizing another embodiment of the closure system of the present invention with an untucked shoelace.
Figure 22:
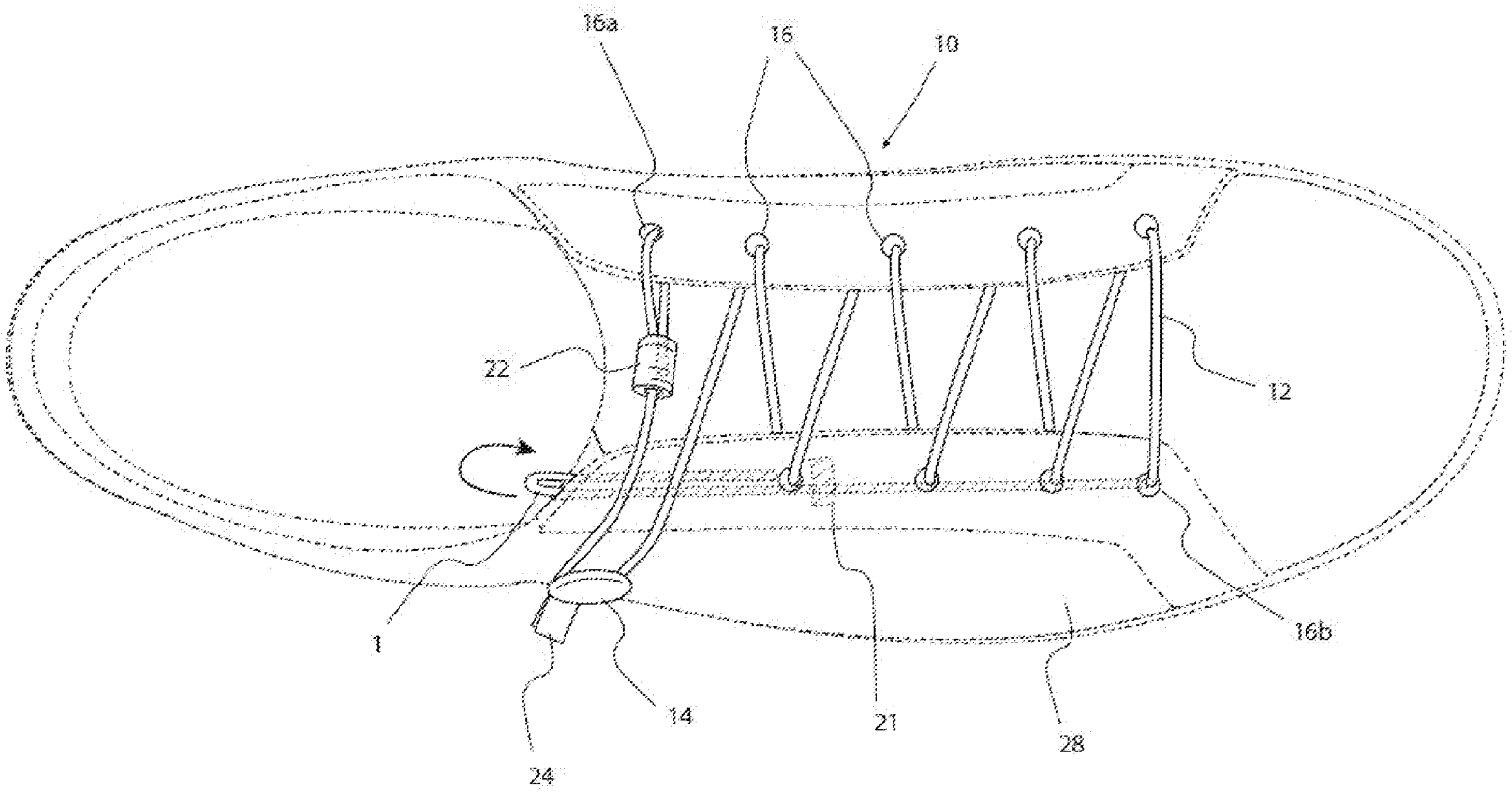
FIG. 22 is a top view of a shoe utilizing the closure system shown in FIG. 21 with the shoelace in a tucked position.
Figure 23:
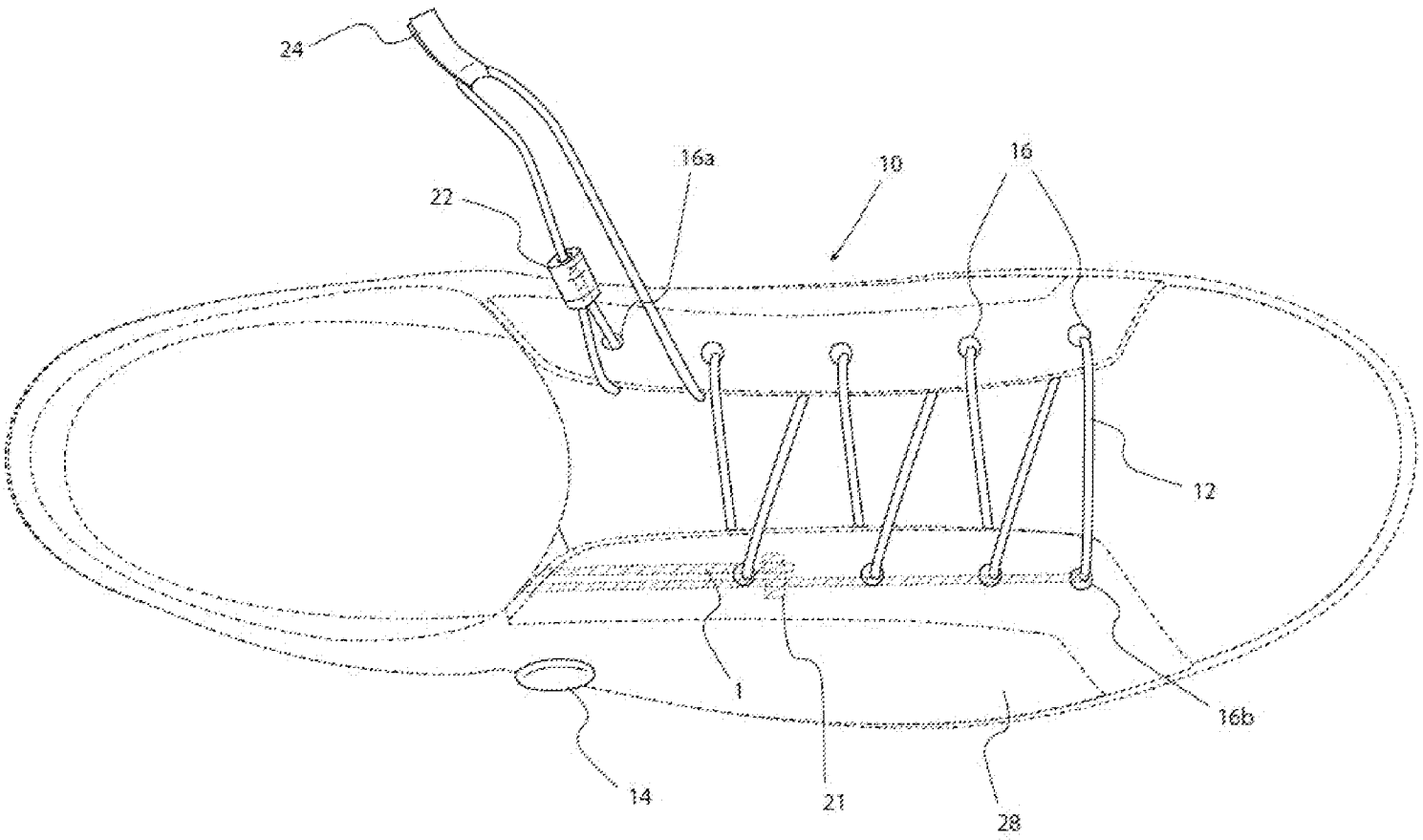
FIG. 23 is a top view of the shoe utilizing the closure system shown in FIG. 21 with the shoelace anchor being loosened.

In the embodiment of FIGS. 13-20, the piping 58 is secured under the upper 28 on each side of the shoe 10 through openings 60,62 in shoe 10. As shown in FIG. 13A, the lace can be crimped onto itself in the same manner as shown in FIG. 1A. In this embodiment, a slider 42 with a slightly different cross section than used in the embodiment of FIGS. 1-8 (and shown in FIG. 12A) may be used as shown in FIG. 12B to be inserted around the piping 58.

Figure 24:
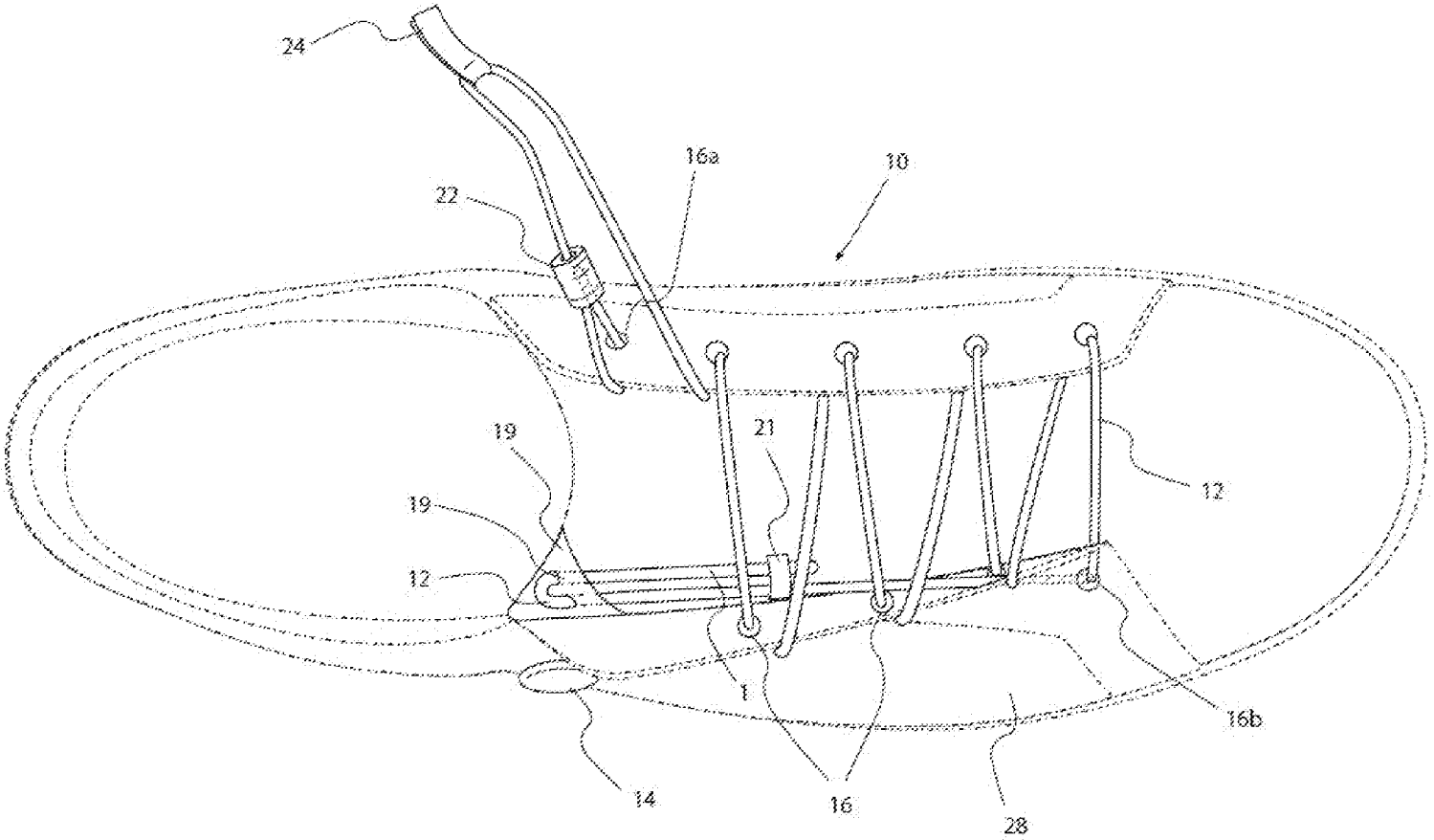
FIG. 24 is a top view of the shoe utilizing the closure system shown in FIG. 21 with the shoelace anchor being loosened and the lateral eyebrow being peeled over to reveal the lace keepers on the lateral/open side of the radial tongue.
Figure 25:
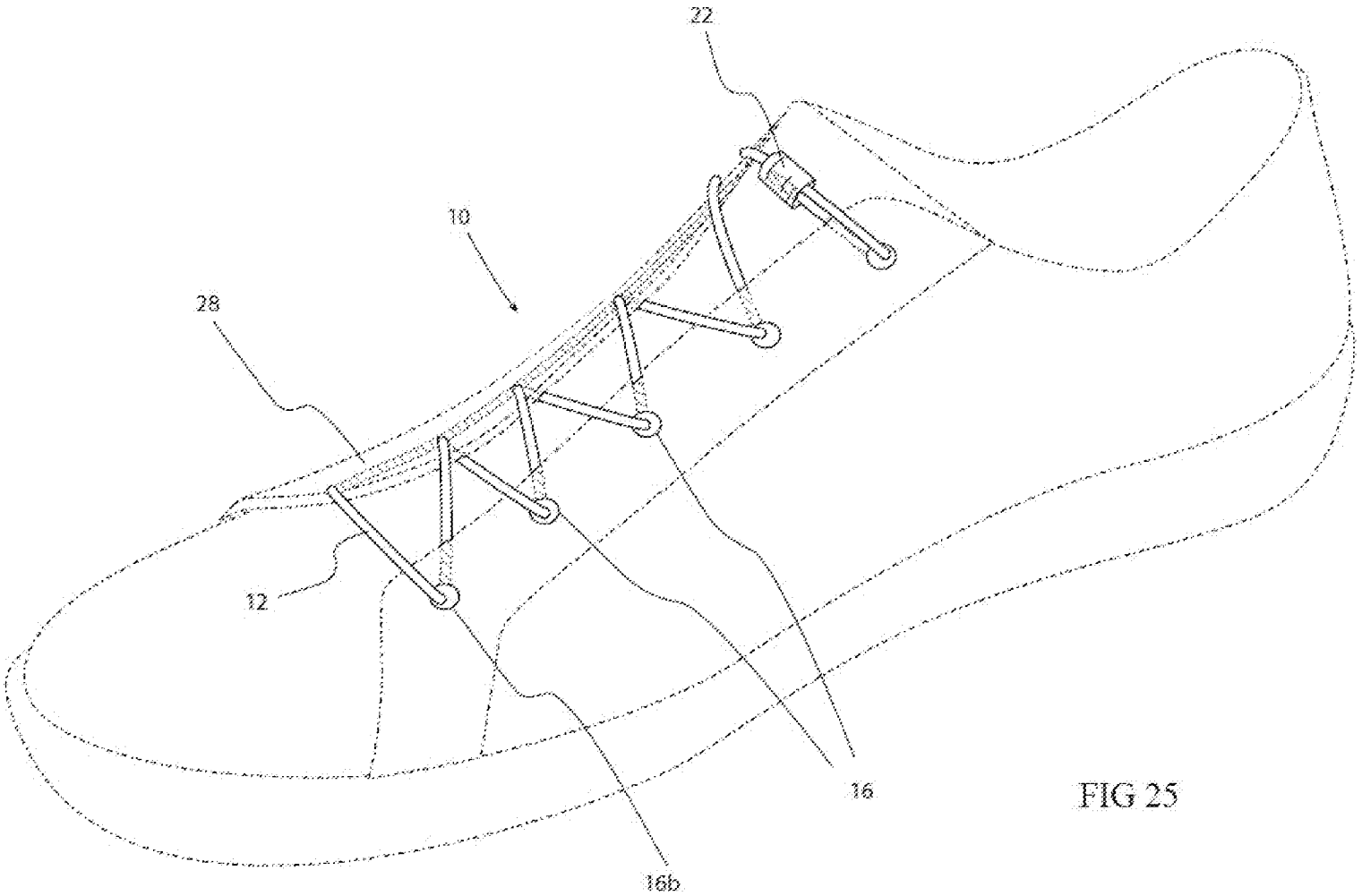
FIG. 25 is a side perspective view of the shoe utilizing the closure system of FIG. 21.
Figure 26:
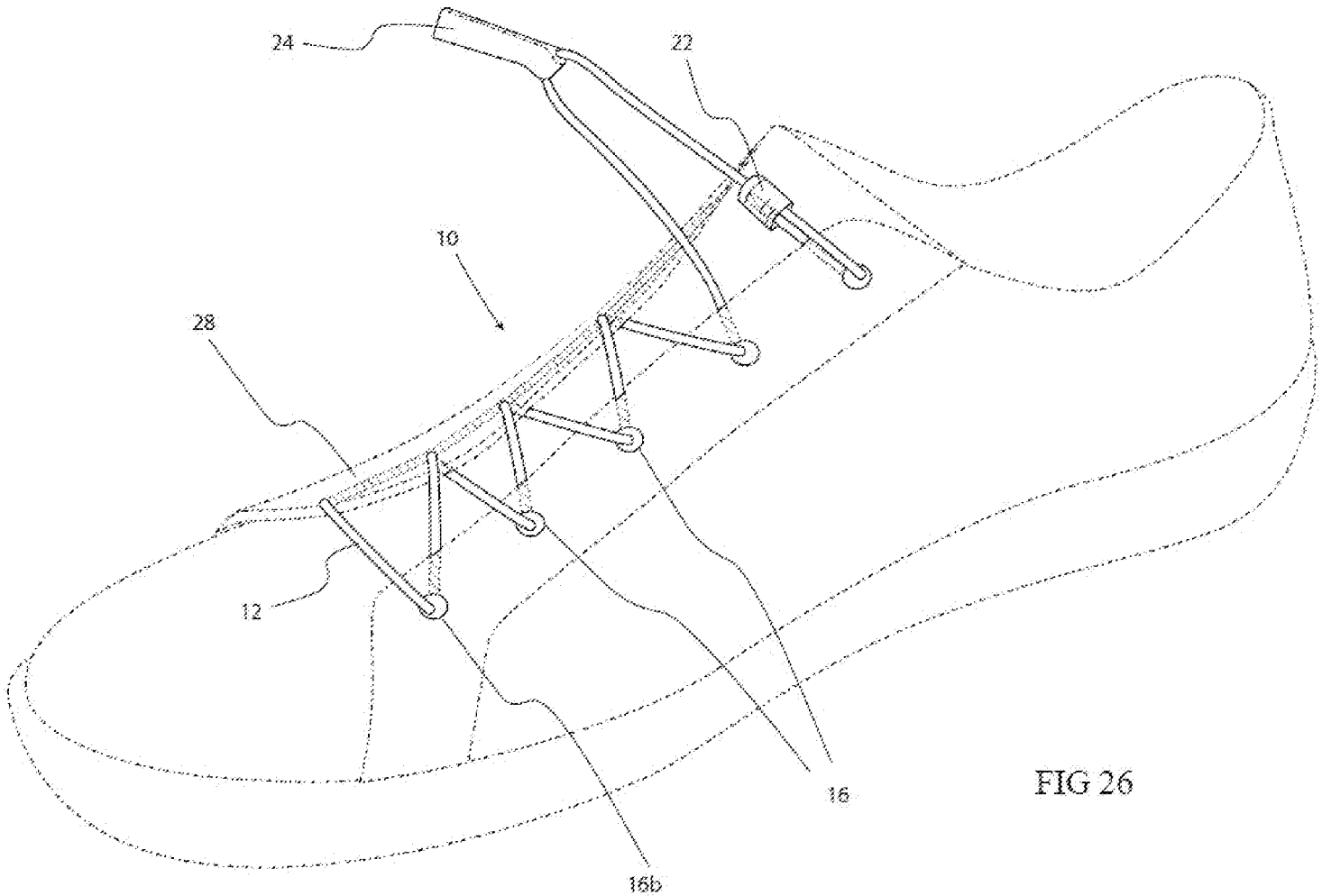
FIG. 26 is a medial side perspective view of the shoe utilizing the closure system shown in FIG. 21 with the shoelace in an unfastened state.
Figure 27:
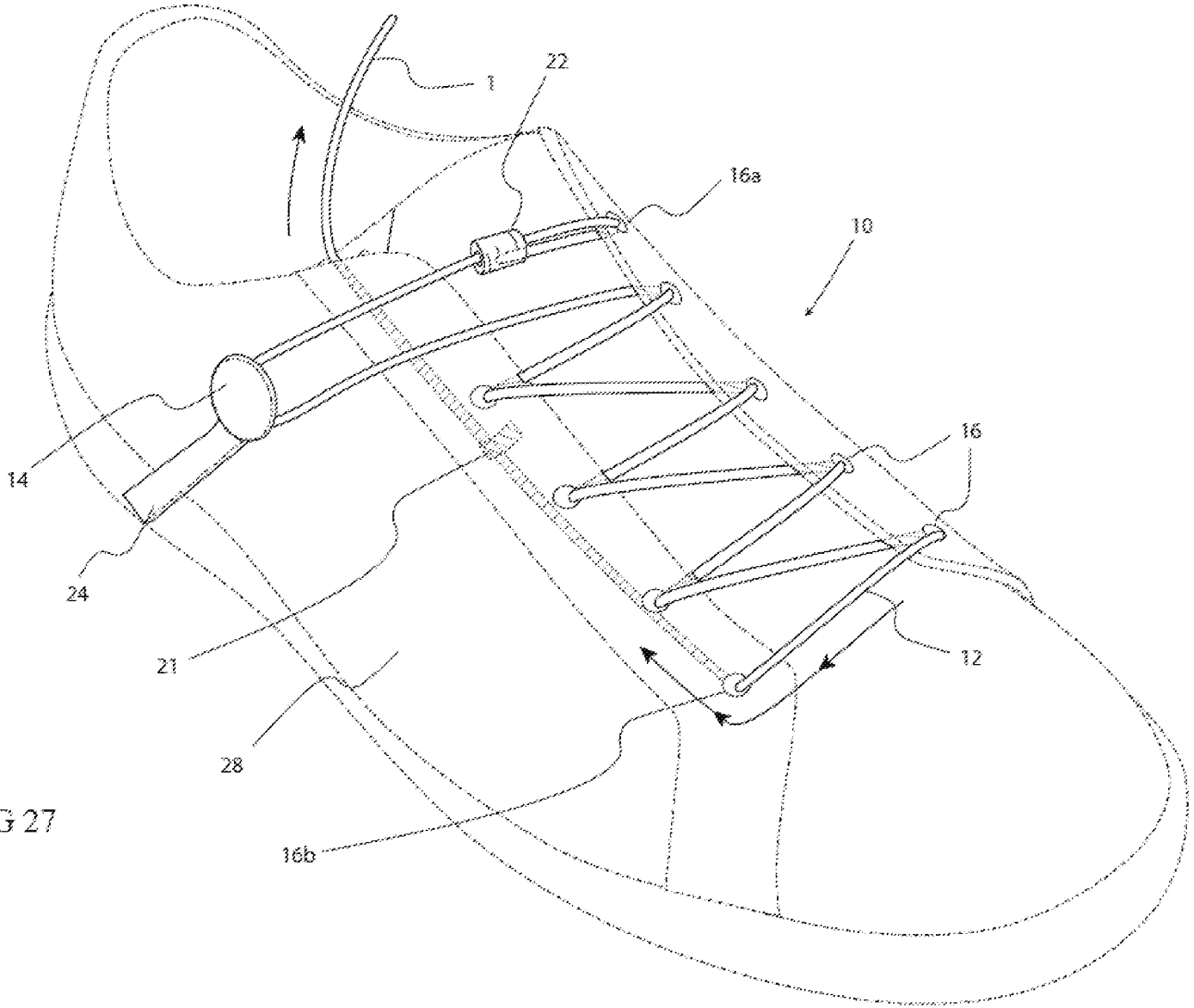
FIG. 27 is a top perspective view as the shoe shown in FIG. 21 with the shoelace in a fastened position without the end of the shoelace being tucked in the shoe.
Figure 28:
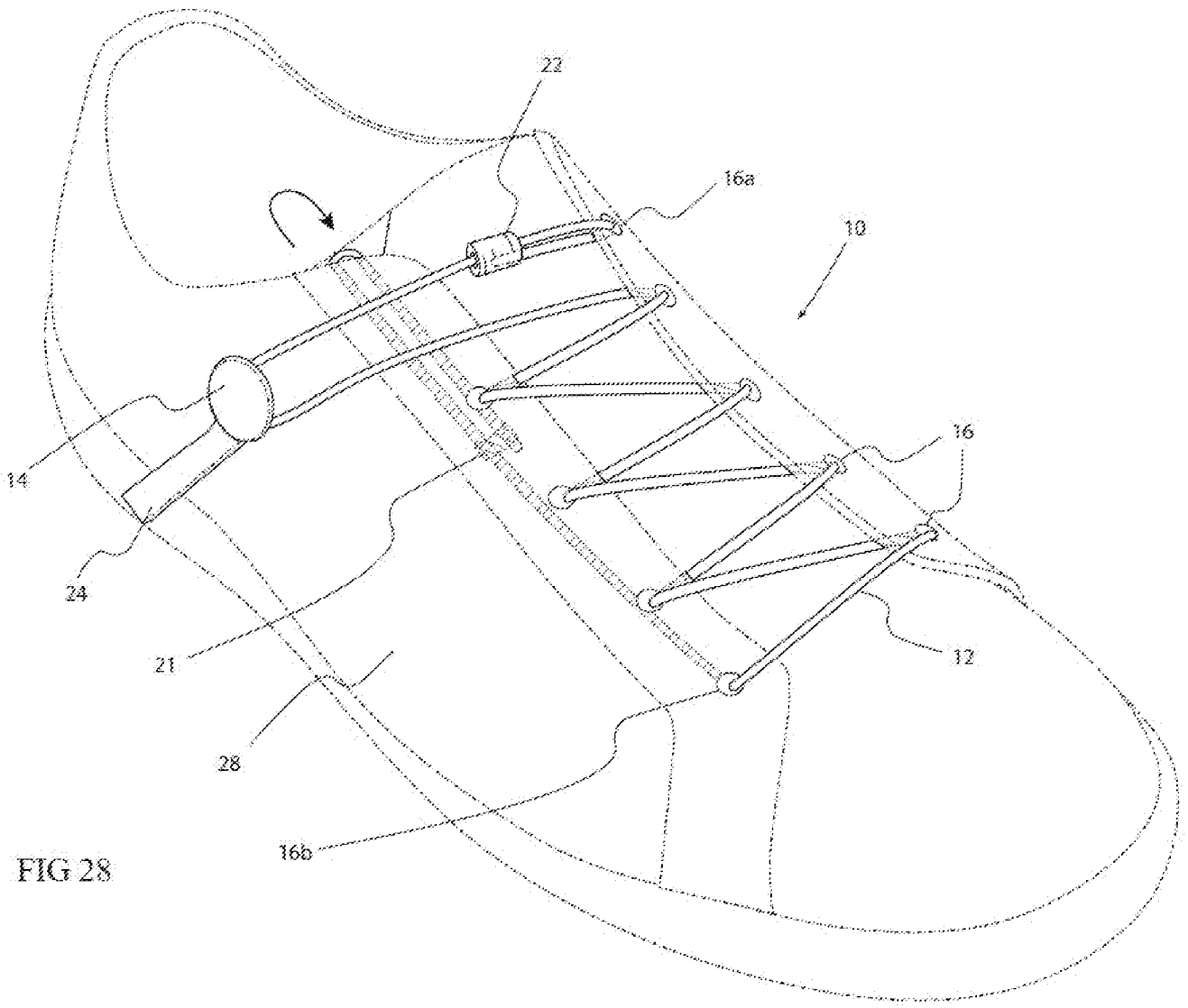
FIG. 28 is a top perspective view of a shoe utilizing the closure system shown in FIG. 27, with the end of the shoelace in a tucked position.

Referring to FIGS. 21-29, a shoe 10 is shown with another embodiment of a closure system that utilizes a single shoelace 12. The shoelace 12 is also inserted in the shoe 10 as a single strand. One end of the shoelace 12 is glued in a barrel 22 that acts as a friction slide. Such fixed end of shoelace 12 could also be compressed in the barrel 22 as well. The shoelace 12 is then threaded through the eyelet 16*a* closest to where a wearer's foot is inserted into the shoe on the flap 18 on the medial side of the shoe 10. The shoelace 12 is then threaded back through the barrel 22 so that the portion of the shoelace 12 that is threaded back through the barrel 22 is slideably fit in barrel 22. A shoelace pull 24 is secured to the shoelace 12 at a portion of the shoelace 12 after it passes through the barrel 22. While leaving some slack in the shoelace 12 to enable the shoelace 12 to be pulled around button 14, the shoelace 12 is then threaded alternately through the eyelets 16 on opposite sides of the shoe until it passes from the top of flap 20 through eyelet 16*b*. The shoelace 12 is then threaded under flap 20 for the length of flap 20. Once the shoelace 12 has been adjusted, free end 12*a* of shoelace 12 is then tucked under flap 20 and through lace keepers 19 and 21 (as shown in FIG. 24), which secure the shoelace 12 under flap 20. As a result, free end 12*a* of the shoelace 12 is tucked out of sight in a position where it is held in place by friction. Other methods of securing the lace by friction will also keep the shoe in a closed state. For example, one could loop the end of the lace through eyelet 16*b* twice and then tying the excess of the lace to itself, or trimming it. Another would be lacing the loose end 12*a* back through the eyelets until the slack is taken up. While these are not preferred mechanisms, they will apply the necessary friction.

Figure 29:
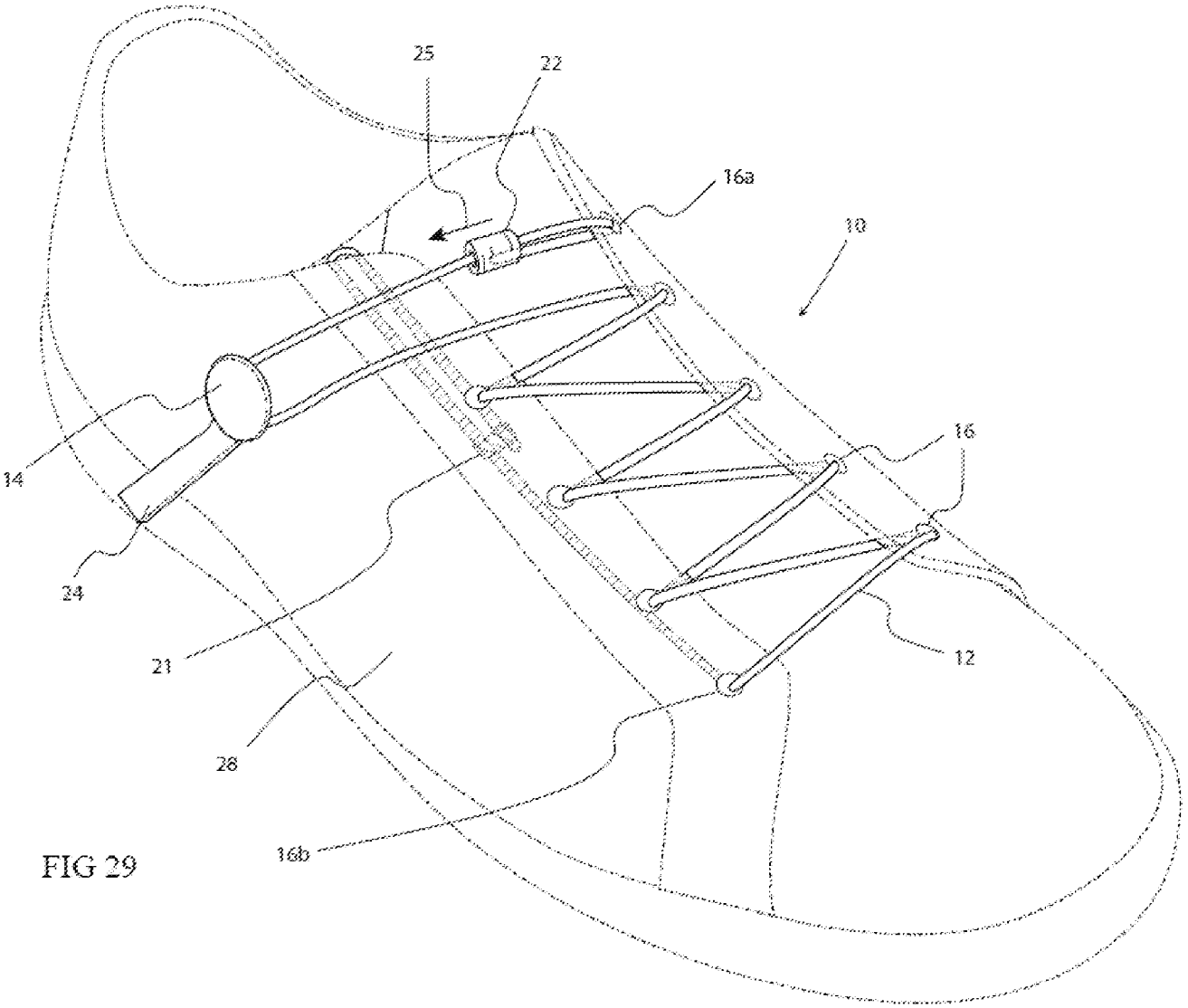
FIG. 29 is a top perspective view of a shoe utilizing the closure system shown in FIG. 27, illustrating the mechanism used for making micro-adjustments.

A lace pull 24 is secured to shoelace 12 to make it easy to pull the shoelace 12 over button 14. For a wearer of the shoe, once the macro adjustment of the tightening of the shoe 10 is made by the pulling of end 12*a* of shoelace 12 and tucking the shoelace 12 away, the user can make micro adjustments of the fit of the shoe 10 by sliding barrel 22 as shown in FIG. 29. The direction of the arrow 25 next to barrel 22 in FIG. 29 indicates a tightening of the shoe 10 when the barrel is moved in the direction of the arrow 25. If the barrel is moved in the opposite direction, there is a micro loosening adjustment on the tension of the shoelace 12.

The shoelace 12 in all of the embodiments can be made of either a static or a dynamic material. When it is made of a dynamic material, it can be more easily stretched to be pulled over button 14. The shoelace 12 is preferably approximately 2 mm cord. Other sizes could be used as long as the shoelace 12 is strong enough to withstand the force and tension from pull and wear but no so thick as to cause irritation when the shoelace 12 is tucked under flap 20.

The foregoing invention has been described with reference to its preferred embodiments. Various alterations and modifications will occur to those skilled in the art. All such alterations and modifications are intended to fall within the scope of the appended claims.

What is claimed is:

1. A shoe, comprising:

a rearmost point and a foremost point defining a shoe length axis from the rearmost point to the foremost point;

two flaps with a first of the two flaps positioned on a lateral side of the shoe and a second of the two flaps positioned on a medial side of the shoe, wherein the lateral side of the shoe and the medial side of the shoe define a lateral-medial axis;

a first series of eyelets in the first of the two flaps;

a second series of eyelets in the second of the two flaps;

an opening configured for insertion of a wearer's foot, said opening having a lateral side and a medial side;

a shoelace having a length sufficient to be threaded alternately between said two flaps through the eyelets in said first and second series of eyelets;

a first end of said shoelace being securely fixed at a location near a first eyelet, wherein the first eyelet is an eyelet from among said first series of eyelets and said second series of eyelets which is located closest to the foremost point along the shoe length axis, said shoelace also being alternately threaded through the eyelets in said first and second series of eyelets;

a second end of said shoelace being threaded under one of said two flaps through a second eyelet, wherein the second eyelet is an eyelet from among said first series of eyelets and said second series of eyelets which is located closest to the opening configured for insertion of a wearer's foot, said second end of said shoelace being secured to a slider which is slidably mounted over a guide positioned around a heel portion of said shoe, said slider being slidable over said guide around the heel portion of said shoe; and whereby said slider is adjustable by sliding said slider over said guide to tighten and loosen the shoe, wherein said guide is one selected from i) a cord secured to an interior of the shoe under an outer surface of the shoe along each of the lateral and the medial side of the opening configured for insertion of a wearer's foot and extends around the heel portion of the shoe, and ii) piping secured to an interior of the shoe under an outer surface of the shoe along each of the lateral and the medial side of the opening configured for insertion of a wearer's foot and extends around the heel portion of the shoe.

2. The shoe of claim 1, further comprising a ridge formed in a heel tab of said shoe for preventing said shoelace from sliding up said heel tab.

3. The shoe of claim 1 wherein said first end of said shoelace is secured under one of the two flaps and defines a second position along the shoe length axis, the first eyelet defines a first position along the shoe length axis, the foremost point defines a third position along the shoe length axis, and the second position is spaced from the first position in a direction along the shoe length axis from said first position to said third position.

4. The shoe of claim 1, wherein said first end of said shoelace is threaded under one of said two flaps and defines a second position along the lateral-medial axis, the first eyelet defines a first position along the lateral-medial axis, a third eyelet in one of the first and second series of eyelets which is opposite the first eyelet along the lateral-medial axis defines a third position along the lateral-media axis, and the second position is spaced apart from the first position in a direction along the lateral-medial axis from the first position to the third position, and wherein the second position is located between the first position and the third position along the lateral-medial axis, said first end of said shoelace being folded over said shoelace.

5. The shoe of claim 1 further comprising a button secured to an upper of said shoe and wherein said shoelace is capable of being secured around said button.

6. The shoe of claim 5 wherein said button includes a top button and a base button, said top button being removably secured to said base button.

7. A shoe, comprising:

a rearmost point and a foremost point defining a shoe length axis from the rearmost point to the foremost point;

two flaps with a first of the two flaps positioned on a lateral side of the shoe and a second of the two flaps positioned on a medial side of the shoe, wherein the lateral side of the shoe and the medial side of the shoe define a lateral-medial axis;

a first series of eyelets in the first of the two flaps;

a second series of eyelets in the second of the two flaps;

an opening configured for insertion of a wearer's foot, said opening having a lateral side and a medial side;

a shoelace having a length sufficient to be threaded alternately between said two flaps through the eyelets in said first and second series of eyelets;

a first end of said shoelace being securely fixed at a location near a first eyelet, wherein the first eyelet is an eyelet from among said first series of eyelets and said second series of eyelets which is located closest to the foremost point along the shoe length axis, said shoelace also being alternately threaded through the eyelets in said first and second series of eyelets;

a second end of said shoelace being threaded under one of said two flaps through a second eyelet, wherein the second eyelet is an eyelet from among said first series of eyelets and said second series of eyelets which is located closest to the opening configured for insertion of a wearer's foot, said second end of said shoelace being secured to a slider which is slidably mounted over a guide positioned around a heel portion of said shoe, said slider being slidable over said guide around the heel portion of said shoe; and whereby said slider is adjustable by sliding said slider over said guide to tighten and loosen the shoe, the shoe further comprising a sole, wherein the slider is not located in the sole.

8. The shoe of claim 1, further comprising a sole, wherein the sole and the opening define a vertical axis from the sole to the opening, the slider and the guide define a second position along the vertical axis, the sole defines a first position along the vertical axis, the opening configured for insertion of a wearer's foot defines a third position along the vertical axis, and the second position is spaced apart from the first position in a direction along the vertical axis from the first position to the third position.

9. A shoe, comprising:

a rearmost point and a foremost point defining a shoe length axis from the rearmost point to the foremost point;

two flaps with a first of the two flaps positioned on a lateral side of the shoe and a second of the two flaps positioned on a medial side of the shoe, wherein the lateral side of the shoe and the medial side of the shoe define a lateral-medial axis;

a first series of eyelets in the first of the two flaps;

a second series of eyelets in the second of the two flaps;

an opening configured for insertion of a wearer's foot, said opening having a lateral side and a medial side;

a shoelace having a length sufficient to be threaded alternately between said two flaps through the eyelets in said first and second series of eyelets;

a first end of said shoelace being securely fixed at a location near a first eyelet, wherein the first eyelet is an eyelet from among said first series of eyelets and said second series of eyelets which is located closest to the foremost point along the shoe length axis, said shoelace also being alternately threaded through the eyelets in said first and second series of eyelets;

a second end of said shoelace being threaded under one of said two flaps through a second eyelet, wherein the second eyelet is an eyelet from among said first series of eyelets and said second series of eyelets which is located closest to the opening configured for insertion of a wearer's foot, said second end of said shoelace being secured to a slider which is slidably mounted over a guide positioned around a heel portion of said shoe, said slider being slidable over said guide around the heel portion of said shoe; and whereby said slider is adjustable by sliding said slider over said guide to tighten and loosen the shoe, wherein said slider is adjustable by sliding said slider from a first position along the lateral-medial axis relative to the guide to a second position along the lateral-medial axis relative to the guide to tighten or loosen the shoe.

10. A shoe, comprising:

a rearmost point and a foremost point defining a shoe length axis from the rearmost point to the foremost point;

two flaps with a first of the two flaps positioned on a lateral side of the shoe and a second of the two flaps positioned on a medial side of the shoe, wherein the lateral side of the shoe and the medial side of the shoe define a lateral-medial axis;

a first series of eyelets in the first of the two flaps;

a second series of eyelets in the second of the two flaps;

an opening configured for insertion of a wearer's foot, said opening having a lateral side and a medial side;

a shoelace having a length sufficient to be threaded alternately between said two flaps through the eyelets in said first and second series of eyelets;

a first end of said shoelace being securely fixed at a location near a first eyelet, wherein the first eyelet is an eyelet from among said first series of eyelets and said second series of eyelets which is located closest to the foremost point along the shoe length axis, said shoelace also being alternately threaded through the eyelets in said first and second series of eyelets;

a second end of said shoelace being threaded under one of said two flaps through a second eyelet, wherein the second eyelet is an eyelet from among said first series of eyelets and said second series of eyelets which is located closest to the opening configured for insertion of a wearer's foot, said second end of said shoelace being secured to a slider which is slidably mounted over a guide positioned around a heel portion of said shoe, said slider being slidable over said guide around the heel portion of said shoe; and whereby said slider is adjustable by sliding said slider over said guide to tighten and loosen the shoe, wherein the guide extends from the medial side of the shoe to the lateral side of the shoe.

11. The shoe of claim 1, wherein the second eyelet defines a first position along the shoe length axis, the rearmost point defines a second position along the shoe length axis, the shoelace extends out of an opening located at a third position along the shoe length axis, and the third position is between the first position and the second position along the shoe length axis.

* * * * *